US011236576B2

(12) United States Patent
Hardesty

(10) Patent No.: US 11,236,576 B2
(45) Date of Patent: Feb. 1, 2022

(54) COMPLEX COMPONENTS FOR MOLDED COMPOSITE FRAC PLUGS

(71) Applicant: GEODYNAMICS, INC., Millsap, TX (US)

(72) Inventor: John Hardesty, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 118 days.

(21) Appl. No.: 16/524,470

(22) Filed: Jul. 29, 2019

(65) Prior Publication Data

US 2020/0056445 A1 Feb. 20, 2020

Related U.S. Application Data

(60) Provisional application No. 62/724,241, filed on Aug. 29, 2018, provisional application No. 62/719,352, filed on Aug. 17, 2018.

(51) Int. Cl.

| | |
|---|---|
| ***E21B 33/12*** | (2006.01) |
| ***E21B 33/124*** | (2006.01) |
| ***E21B 33/129*** | (2006.01) |
| ***E21B 17/14*** | (2006.01) |

(52) U.S. Cl.

CPC ..... *E21B 33/1208* (2013.01); *E21B 17/14* (2013.01); *E21B 33/124* (2013.01); *E21B 33/1293* (2013.01)

(58) Field of Classification Search

CPC .... E21B 33/1208; E21B 33/134; E21B 33/12; E21B 33/124; E21B 33/1293

See application file for complete search history.

(56) References Cited

U.S. PATENT DOCUMENTS

| | | | | |
|---|---|---|---|---|
| 3,623,551 | A | 11/1971 | Randermann, Jr. | |
| 8,066,065 | B2 | 11/2011 | Buckner | |
| 2008/0105462 | A1* | 5/2008 | May | E21B 33/085 175/7 |
| 2009/0255692 | A1* | 10/2009 | Coronado | E21B 33/128 166/387 |
| 2011/0024134 | A1* | 2/2011 | Buckner | E21B 33/1204 166/382 |
| 2012/0125637 | A1* | 5/2012 | Chenault | E21B 33/134 166/382 |
| 2013/0048271 | A1 | 2/2013 | VanLue | |
| 2013/0240201 | A1* | 9/2013 | Frazier | E21B 33/134 166/135 |
| 2013/0299192 | A1 | 11/2013 | Xu et al. | |

(Continued)

FOREIGN PATENT DOCUMENTS

WO 2016160003 A1 10/2016

OTHER PUBLICATIONS

International Search Report and Written Opinion, dated Dec. 11, 2018, from corresponding/related International Application No. PCT/US2018/054539.

*Primary Examiner* — Kristyn A Hall

(74) *Attorney, Agent, or Firm* — Patent Portfolio Builders PLLC

(57) ABSTRACT

A downhole isolation tool for sealing a casing in a well, the downhole isolation including plural parts made of a composite material, each part having a preset functionality with regard to sealing the casing; and a sealing element configured to seal the casing. At least two parts of the plural parts have a single, combined body.

21 Claims, 26 Drawing Sheets

(56) References Cited

U.S. PATENT DOCUMENTS

| | | | | |
|---|---|---|---|---|
| 2014/0158378 | A1 | 6/2014 | Xu et al. | |
| 2015/0013996 | A1 | 1/2015 | Davies et al. | |
| 2015/0184485 | A1 | 7/2015 | Xu et al. | |
| 2015/0300121 | A1* | 10/2015 | Xu | E21B 33/128 166/118 |
| 2016/0186511 | A1 | 6/2016 | Coronado et al. | |
| 2017/0074051 | A1* | 3/2017 | Atkins | F16L 15/00 |
| 2017/0268310 | A1 | 9/2017 | Shkurti et al. | |

* cited by examiner

COMPLEX COMPONENTS FOR MOLDED COMPOSITE FRAC PLUGS

BACKGROUND

Technical Field

Embodiments of the subject matter disclosed herein generally relate to downhole tools used for perforating and/or fracturing operations, and more specifically, to a downhole isolation tool that includes a complex composite element.

Discussion of the Background

In the oil and gas field, once a well 100 is drilled to a desired depth H relative to the surface 110, as illustrated in FIG. 1, and the casing 102 protecting the wellbore 104 has been installed and cemented in place, it is time to connect the wellbore 104 to the subterranean formation 106 to extract the oil and/or gas. This process of connecting the wellbore to the subterranean formation may include a step isolating a stage of the casing 102 with a plug 112, a step of perforating the casing 102 with a perforating gun assembly 114 such that various channels 116 are formed to connect the subterranean formations to the inside of the casing 102, a step of removing the perforating gun assembly, and a step of fracturing the various channels 116.

Some of these steps require to lower in the well 100 a wireline 118 or equivalent tool, which is electrically and mechanically connected to the perforating gun assembly 114, and to activate the gun assembly and/or a setting tool 120 attached to the perforating gun assembly. Setting tool 120 is configured to hold the plug 112 prior to isolating a stage and also to set the plug. FIG. 1 shows the setting tool 120 disconnected from the plug 112, indicating that the plug has been set inside the casing.

FIG. 1 shows the wireline 118, which includes at least one electrical connector, being connected to a control interface 122, located on the ground 110, above the well 100. An operator of the control interface may send electrical signals to the perforating gun assembly and/or setting tool for (1) setting the plug 112 and (2) disconnecting the setting tool from the plug. A fluid 124, (e.g., water, water and sand, fracturing fluid, etc.) may be pumped by a pumping system 126, down the well, for moving the perforating gun assembly and the setting tool to a desired location, e.g., where the plug 112 needs to be deployed, and also for fracturing purposes.

The above operations may be repeated multiple times for perforating and/or fracturing the casing at multiple locations, corresponding to different stages of the well. Note that in this case, multiple plugs 112 and 112' may be used for isolating the respective stages from each other during the perforating phase and/or fracturing phase.

These completion operations may require several plugs run in series or several different plug types run in series. For example, within a given completion and/or production activity, the well may require several hundred plugs depending on the productivity, depths, and geophysics of each well. Subsequently, production of hydrocarbons from these zones requires that the sequentially set plugs be removed from the well. In order to reestablish flow past the existing plugs, an operator must remove and/or destroy the plugs by milling, drilling, or dissolving the plugs.

A typical frac plug for such operations is illustrated in FIG. 2 and include various elements. For example, the frac plug 200 has a central, interior, mandrel 202 on which all the other elements are placed. The mandrel acts as the backbone of the entire frac plug. The following elements are typically added over the mandrel 202: a top push ring 203, upper slip ring 204, upper wedge 206, elastic sealing element 208, lower wedge 210, lower slip ring 212, a bottom push ring 216, and a mule shoe 218. When the setting tool (not shown) applies a force on the push ring 203 on one side and applies an opposite force on the bottom push ring 216 from the other side, the intermediate components press against each other causing the sealing element 208 to elastically expand radially and seal the casing. Upper and lower wedges 206 and 210 press not only on the seal 208, but also on their corresponding slip rings 204 and 212, separating them into plural parts and at the same time forcing the separated parts of the slip rings to press radially against the casing. In this way, the slip rings maintain the sealing element into a tension state to seal the well and prevent the elastic sealing element from returning to its initial position. Note that in its initial position, the elastic sealing element does not contact the entire inner circumference of the casing to seal it. When the upper and lower wedges 206 and 210 swage the elastic sealing element to seal the casing, the elastic sealing element elastically deforms and presses against the entire circumference of the casing.

Traditionally, the various components of the frac plug 200 are made of cast iron, which is heavy and difficult to manipulate. Thus, recently, some of these components have been made of composite materials instead of cast iron, resulting in what is known today as composite frac plugs. These parent product lines benefit from a design philosophy of simple, modular components that can be mixed and matched to create different end assemblies. This is driven by the efficiency drivers around molding/machining operations necessary to create cast iron components. Mule shoes, mandrels, wedges, slip rings, and extrusion preventers are the typical components of every plug. Modern frac plugs that use composite components are designed based on this heritage, but they do not reap all of the same benefits that the cast iron products do.

Thus, there is a need to provide an improved composite frac plug that is not hostage to the technology used to make the cast iron frac plugs.

SUMMARY

According to an embodiment, there is a downhole isolation tool that includes plural parts made of a composite material, each part having a preset functionality with regard to sealing the casing, and a sealing element configured to seal the casing. At least two parts of the plural parts have a single, combined body.

According to another embodiment, there is a method of manufacturing a downhole isolation plug for sealing a casing in a well, and the method includes manufacturing at least two parts of plural parts during a single step by using a composite material, each part having a preset functionality with regard to sealing the casing, and adding a sealing element to the plural parts, wherein the sealing element is configured to seal the casing. The at least two parts of the plural parts have a single, combined body.

In still another embodiment, there is a downhole isolation plug for sealing a casing in a well. The downhole isolation plug includes a slip ring disposed on a mandrel, a mule shoe also disposed on the mandrel, and a sealing element configured to seal the casing. The mule shoe is attached to the mandrel with a locking mechanism located at an interface between the mandrel and the mule shoe.

BRIEF DESCRIPTION OF THE DRAWINGS

The accompanying drawings, which are incorporated in and constitute a part of the specification, illustrate one or more embodiments and, together with the description, explain these embodiments. In the drawings:

FIG. 3A shows the various elements of a plug while

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a composite plug. However, the embodiments discussed herein are applicable to other downhole tools.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 3A:
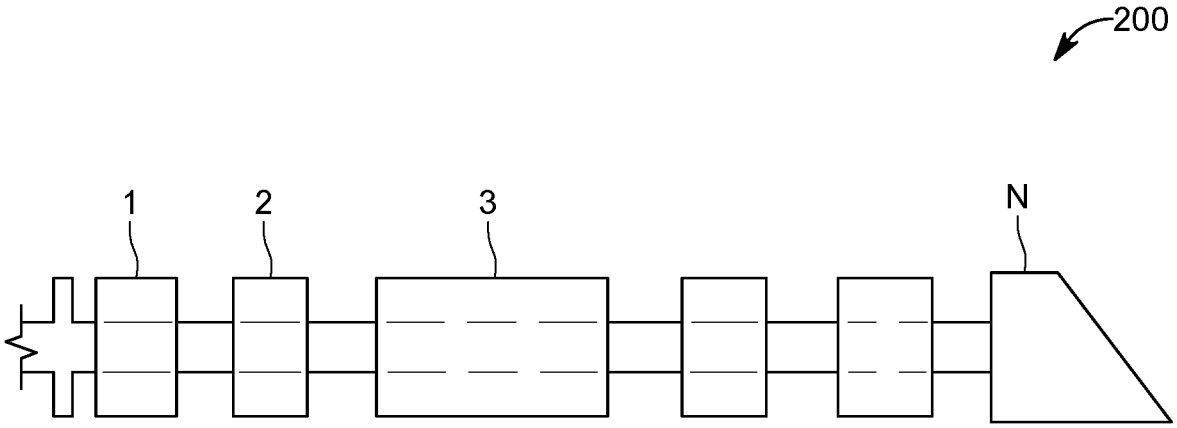
Figure 3B:
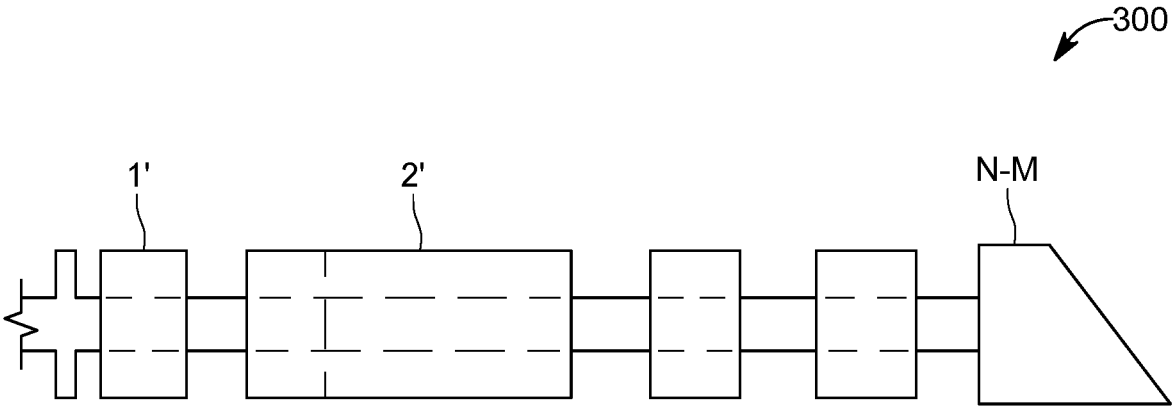
FIG. 3B shows a novel plug having less components.

According to an embodiment illustrated in FIGS. 3A and 3B, a novel plug 300 is designed to have at least one component less than a traditional plug 200. Note that FIG. 3A shows the traditional plug 200 having N elements, where N varies depending on the manufacturer, while FIG. 3B shows the novel plug 300 having N−M elements, with M being an integer between 1 and N−1. FIG. 3B shows that the novel plug 300 has at least two traditional elements 2 and 3 fabricated in a single step as a new unitary element 2', i.e., a combined composite element. Note that any two adjacent elements may be fabricated as a unitary, combined, new element. As these elements are made of a composite material (which may include a combination of a polymer matrix reinforced with fibers, but other elements are also possible), it is possible that during the manufacturing process, the two or more parts are made simultaneously to have a common layer of fibers. For example, one way of making composite materials is the filament winding process. During this process, a machine pulls fiber bundles through a wet bath of resin and wound them over a rotating steel mandrel with specific orientations, where the steel mandrel has an external diameter that coincides with the internal diameter of the desired element to be made. The steel mandrel is then removed and the composite element can be further processed if necessary, for example, to add ceramic elements to the slip set, or to cut grooves, etc. Instead of making two composite elements of the plug 200 as two different elements, this method may be used to make a single, combined element, which provides the functionality of the two different elements of the traditional plug 200.

In one embodiment it is possible to make a single, combined element of the plug having the functionality of more than two different parts. In another embodiment, it is possible to make the entire structure of the plug as a single combined element. Note that the filament winding process discussed above is just an example for illustrating the novel concept of the combined composite elements of the plug 300. However, other processes as bladder molding, compressing molding, autoclave and vacuum bag, mandrel wrapping, wet layup, chopper gun, pultrusion resin transfer molding, etc. may be used with the same results.

While FIG. 3B appear to show that the slip ring 2 and the wedge 3 of the traditional plug 200 have been made as a single, combined element 2', one skilled in the art should understand that any two adjacent elements of a traditional plug may be made as a single, combined element in the new plug. In one application, more than two parts may be made as a single, combined element. A couple of specific implementations of this concept are now discussed with regard to the figures.

Figure 1:
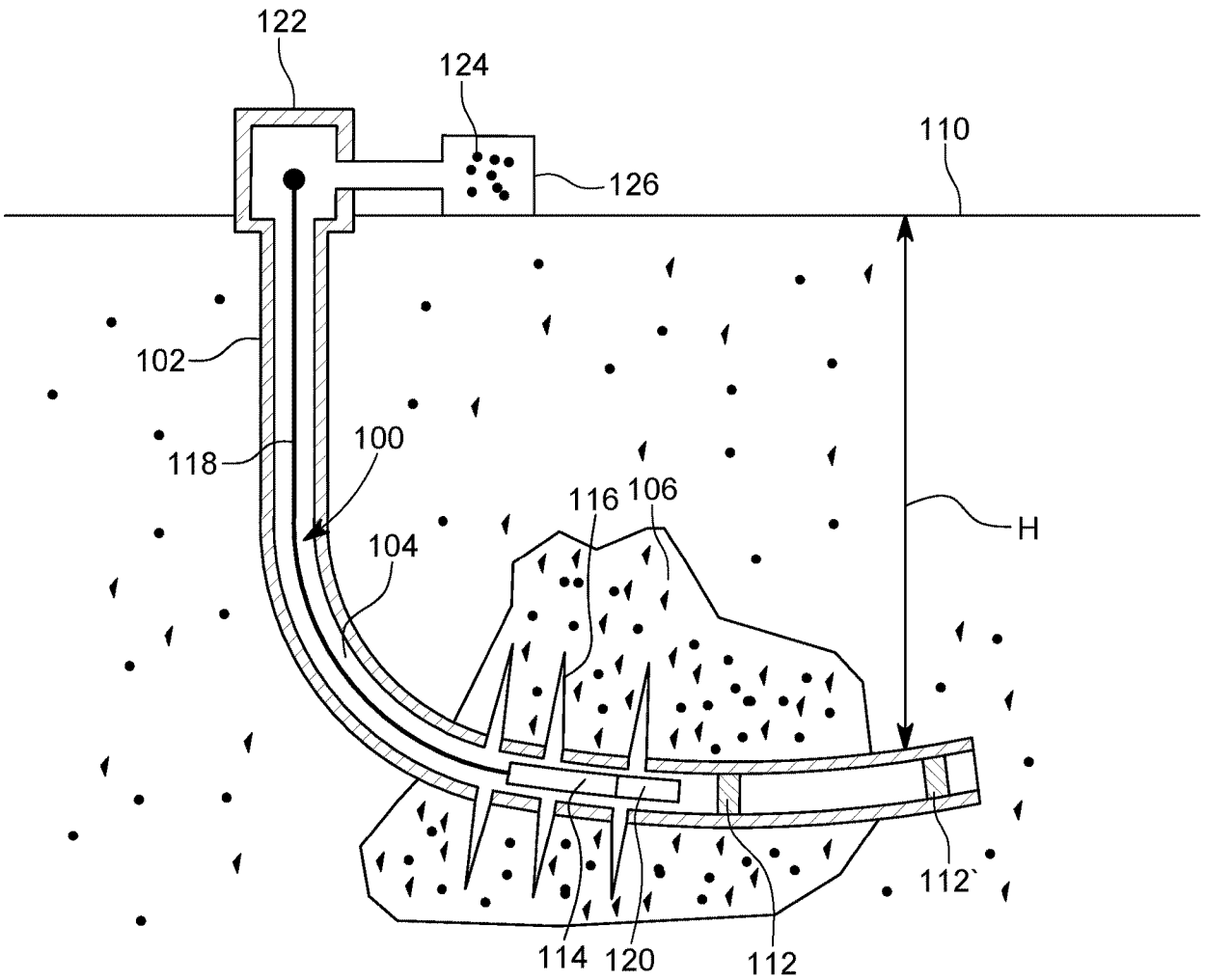
FIG. 1 (BACKGROUND ART)
FIG. 1 illustrates a well and associated equipment for well completion operations.
Figure 2:
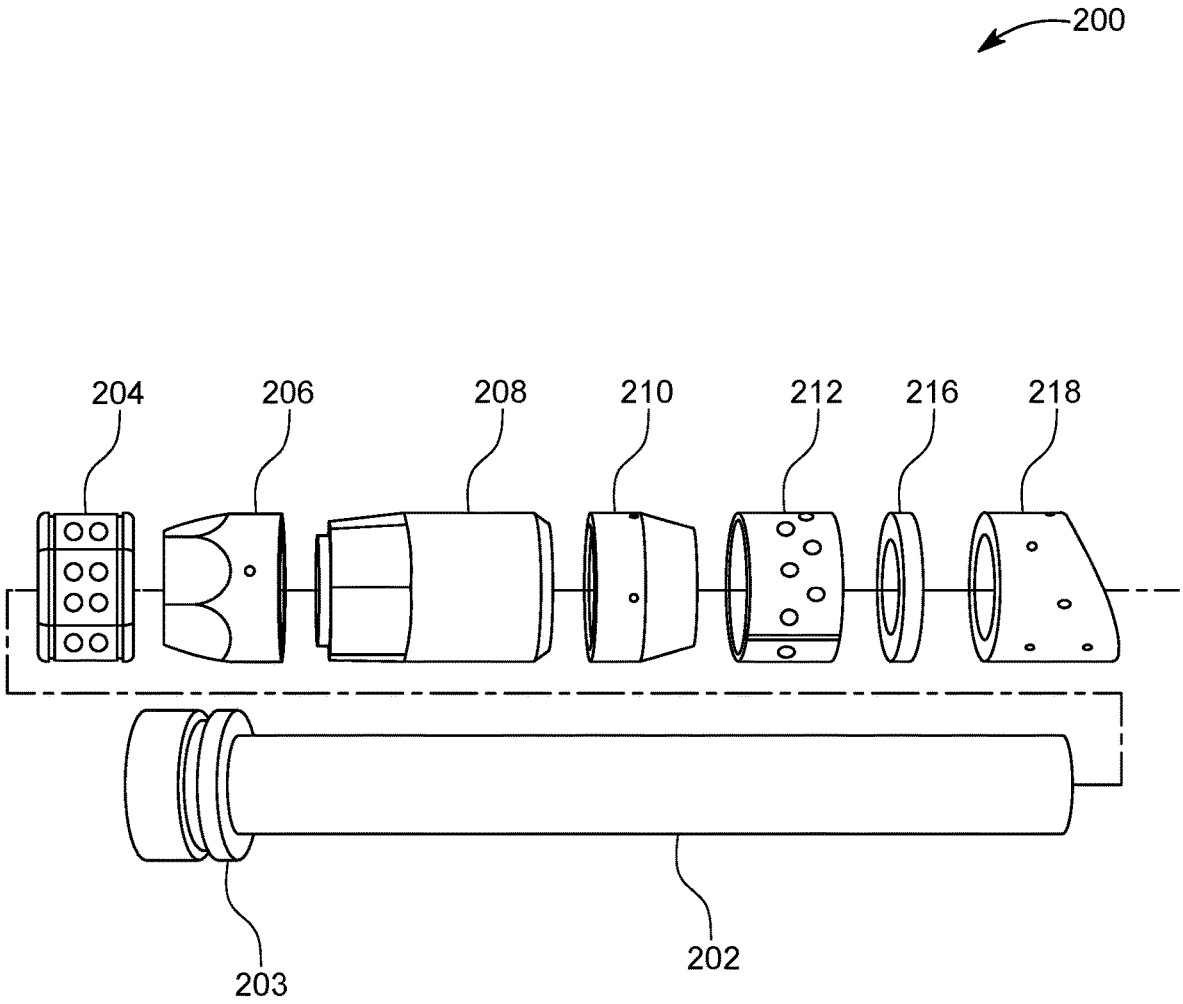
FIG. 2 (BACKGROUND ART)
FIG. 2 illustrates a traditional composite plug having an internal mandrel.
Figure 4A:
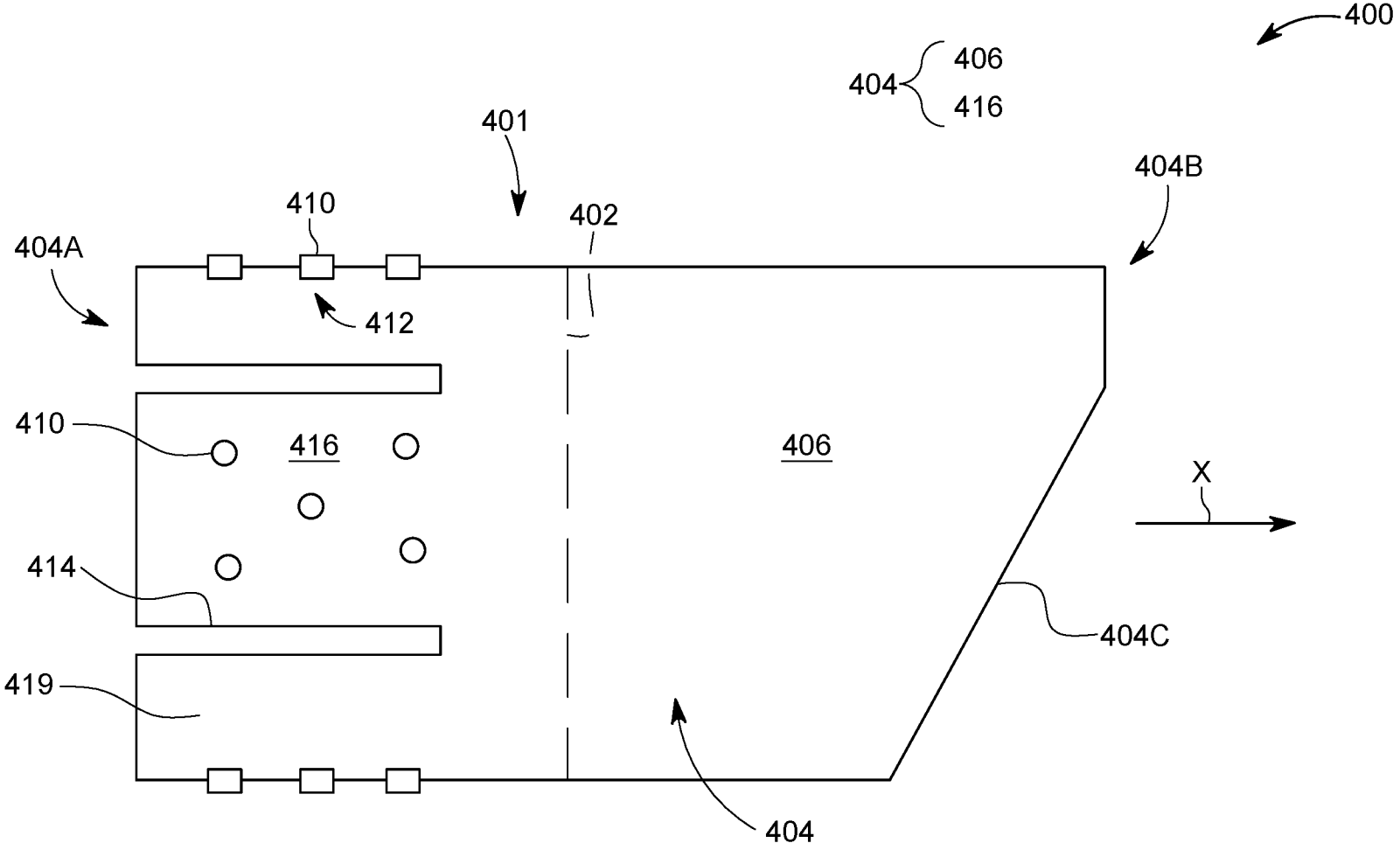
FIGS. 4A to 4D illustrate a composite plug that has at least two parts made to have a single, combined body.

FIG. 4A shows a single, combined plug element 401, which is part of a plug 400, that achieves the functionality of the lower slip ring 212 and mule shoe 218 of the plug 200 shown in FIG. 2. An imaginary dash line 402 divides the combined plug element 401 into two parts, a mule shoe part 406 and a slip ring part 416, which would effectively correspond to parts 212 and 218 of the plug 200. However, in reality, there is no line, groove or mark where the imaginary dash line 402 is shown to separate or distinguish the slip ring part 416 from the mule shoe part 406. Thus, the single, combined plug element 401 could not be said to be made of the two parts of a traditional plug 200 that are joined by a bridge portion, because these parts are not attached to each other with a bridge or another connecting element, they are simply made to be a single element. Further, these two parts lose their specific identity as they become a single body. Furthermore, the transition part at line 402, between the slip ring part and the mule shoe part, is not extending radially or along another direction from one part to another, it is simply part of both the slip ring part and the mule shoe part. In other words, as the single, combined body 404 of the plug 400 that has been manufactured during a single step, with composite materials that are shaped with one of the processes discussed above, there is in fact no transition part or bridge or connection part, but just one single element or component. This means that the chemical and morphological structure of element 401 is the same just before line 402, at line 402, and after line 402 when advancing along a longitudinal axis X as illustrated in FIG. 4A.

Figure 4B:
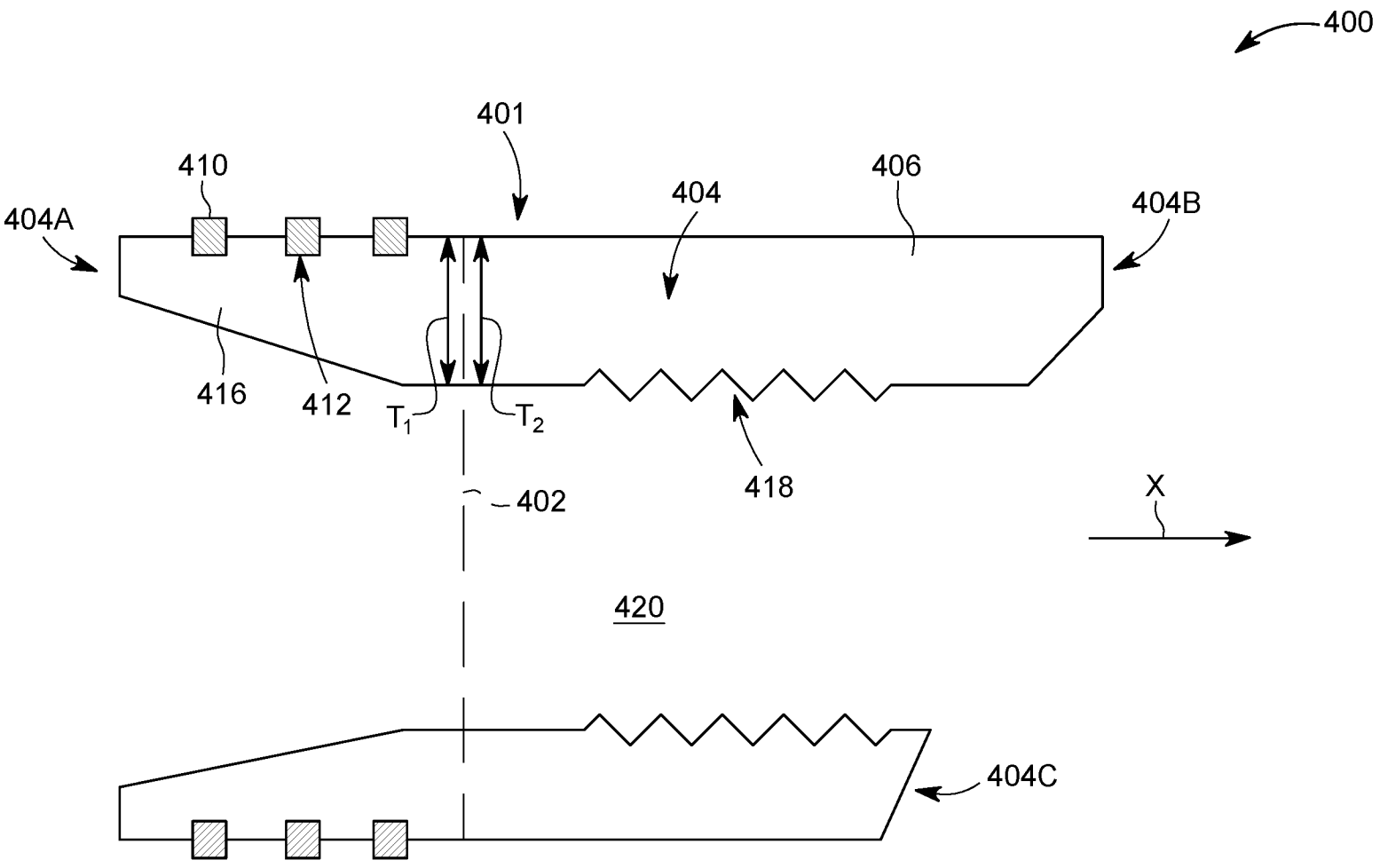
Figure 4C:
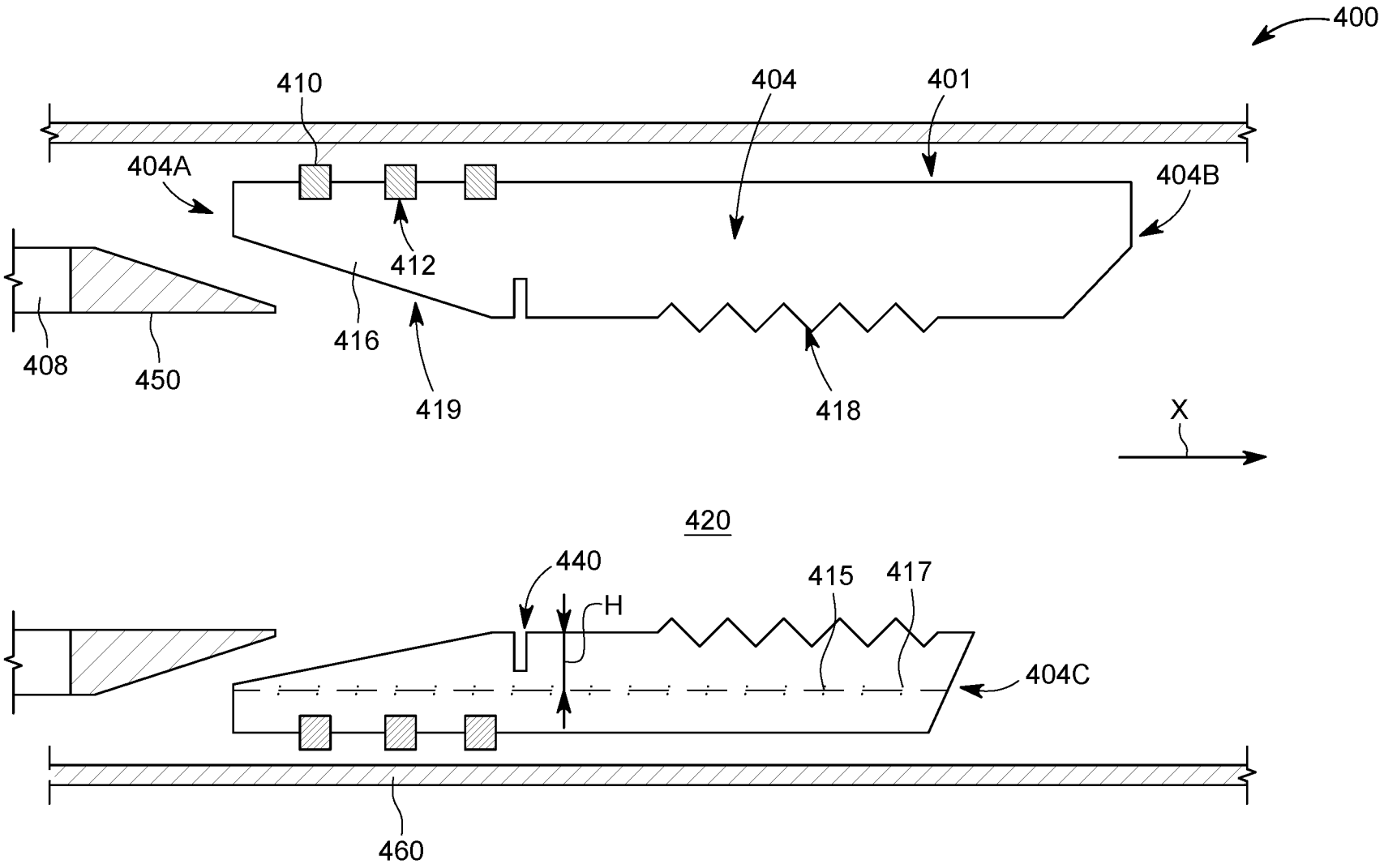

In this respect, FIG. 4B shows a cross-section of the single, combined element 401 that indicates that at the hypothetical location of the imaginary line 402, there is no difference in the wall of the element either before or after the line, along the longitudinal axis X. In one application, a thickness T1 of the slip ring part 416 is the same as a thickness of the mule shoe part 406, as illustrated in FIG. 4B. Further, FIG. 4C shows that there is at least one layer 415 of fibers 417, that are added during the manufacturing process to form the body 404, that extends from the upstream end 404A of the body to the downstream end 404B. Note that the fibers 417 that are used to make the composite material do not have to be long fibers, they may parts of fibers as used in a chopper gun process, where the fibers are cut prior to being used to make the body 404. Layer 415 may be formed to have this configuration for any of the embodiments discussed herein. While FIG. 4C shows such layer, some of the embodiments discussed here do not have to have such a layer that extends from one end to the other end of the body.

Returning to FIG. 4A, it shows that at the upstream end 404A of the element 401, there are plural buttons 410, which may be located in a corresponding recess 412. The plural buttons 410 may be added as the fibers of the composite material are being put in place during the manufacturing process, or they may be added after the composite material of element 401 has been cured. The buttons 410 are made of a highly abrasive material (e.g., ceramic) and their role is to engage the bore of the casing inside the well and set the plug, i.e., prevent it from moving up or down the well when a high pressure is applied.

Optionally, slots 414 may be cut at the upstream end 404A, between groups of buttons, to make a finger like structure so that when a wedge element (not shown) presses against these fingers 419, they break or bend easily from the main body 404, toward the casing 460 (see FIG. 4C) to make the buttons engage with the casing. In one embodiment, no slots are formed in the upstream end 404A, but only some grooves, to achieve the same end result. The grooves may be formed the outside surface of the body 404, or the inside surface, or both. In one application, optional circumference grooves 440 (see FIG. 4C) may be formed in the inside surface of the body 404, so that when a wedge element 450 is pushed against the upstream part 404A of the body, the fingers 419 having the buttons 410 break or bend easily relative to the other part of the body 404, and engage with the casing 460. Note that in one embodiment, the grooves 440 are not very deep, so that the fingers 419 remain connected to the body 404 even after the buttons 410 have engaged the casing 460, i.e., the plug is set. A depth H of the groove 440 can be selected to either achieve complete detachment of the fingers 419 from the body 404, or to maintain the integral structure with the body 404 even after the plug has been set up. FIG. 4C also shows a sealing element 408 located next to the wedge element 450.

Note that in this application, the terms "upstream" and "downstream" are used to indicate a direction toward the head of the well or the toe of the well, respectively, irrespective of whether the well is a horizontal, vertical or deviated well.

Figure 4D:
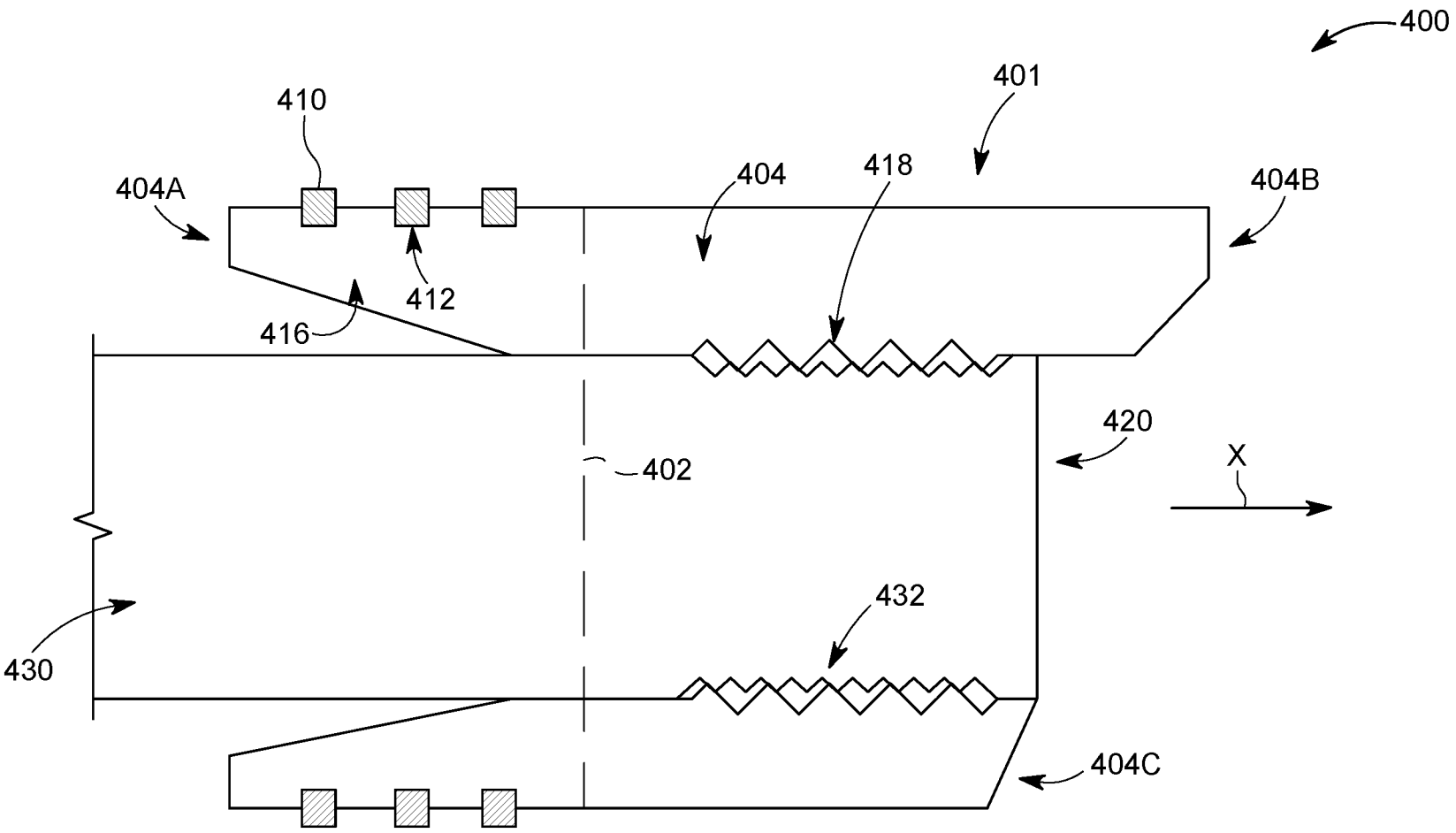

The downstream end 404B of the element 401 is shaped similar to a mule shoe 218 (see FIG. 2), i.e., a toe facing face 404C of the body 404 is making an angle different than 90 degrees with the longitudinal axis X. To attach the single, combined element 401 to a mandrel 430 of the plug 400, in one embodiment, threads 418 are formed in the body 404, facing the bore 420, as illustrated in FIGS. 4B and 4D. The mandrel 430 may have mating treads 432 that engage the threads 418, as shown in FIG. 4D so that the single, combined element 401 can be fixedly attached to the mandrel. In one embodiment, the combined element 401 could be pinned to the mandrel 430 instead of being attached with threads. Other mechanisms may be used for attaching element 401 to the mandrel, as discussed later.

The single combined element 401 discussed with regard to FIGS. 4A to 4D would provide a direct benefit in terms of cost reduction, and would enable new designs which would better space and align the slip rings, causing them to engage between the wedge and the casing prior to breaking from the mule shoe. Further, the combined element 401 is neither a slip ring nor a mule shoe, but a new element that implements the functionalities of both the slip ring and the mule shoe. The combined element 401 would be more resistant to preset, because the connection to the mule shoe could be stronger than the band retention on individual slips, and better distributed than a traditional "one piece slip."

Figure 5:
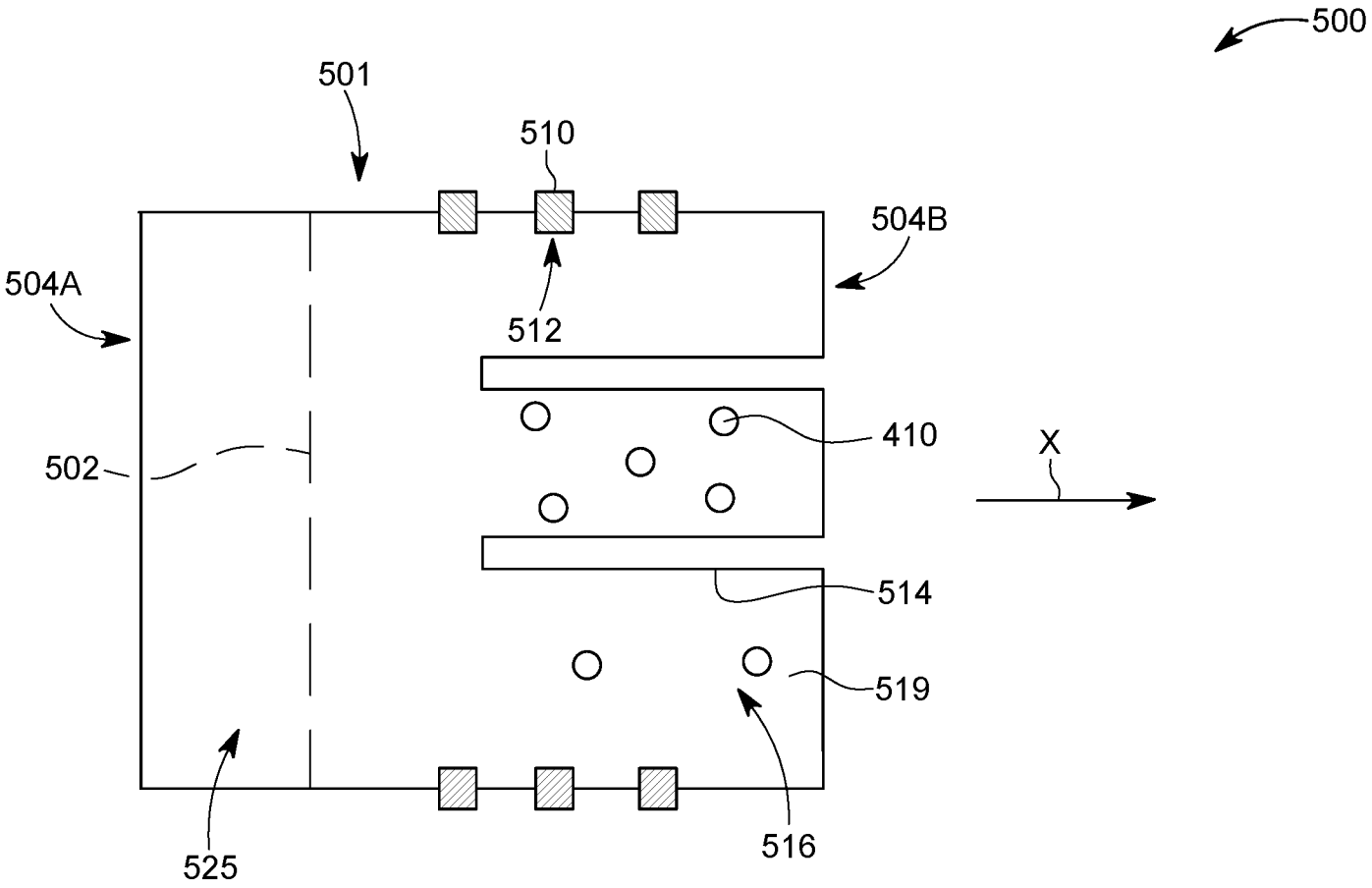
FIG. 5 illustrates another composite plug that has at least two parts made to have a single, combined body.

In another embodiment, as illustrated in FIG. 5, the top slip ring may be integrated with a push ring to form a single, combined element 501 of a plug 500. Element 501 has a body 504 that, if divided by an imaginary line 502, corresponds to a slip ring part 516 and a push ring part 525. The upstream end 504A of the body corresponds to the push ring and the downstream end 504B of the body corresponds to the top slip ring. The downstream end 504B includes buttons 510, similar to the buttons 410 shown in FIGS. 4A to 4D, which are placed in corresponding grooves 512. One or more slots 514 may be formed in the downstream end 504B, to form fingers 519, which have the same purpose as the fingers 419 of the element 401. Similar to the embodiment of FIG. 4B, a thickness of the wall of element 501 about imaginary line 502 may be uniform and made of the same identical composite material made during a step manufacturing step.

Figure 6:
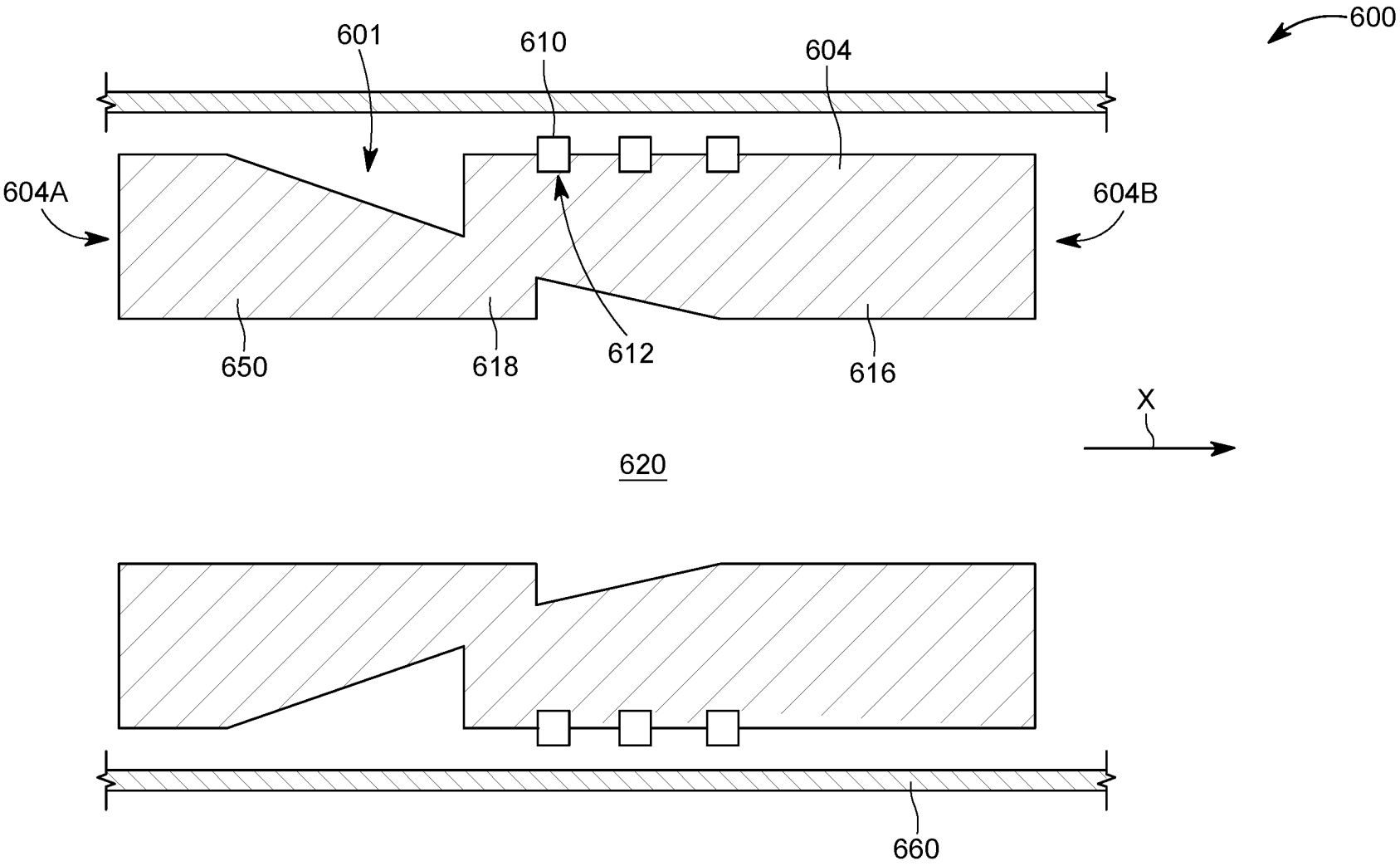
FIG. 6 illustrates yet another composite plug that has at least two parts made to have a single, combined body.

In still another embodiment illustrated in FIG. 6, the slip ring of the plug 200 is integrated with the corresponding wedge, to form a single, combined element. FIG. 6 shows a single, combined element 601 of a plug 600 that has a single body 604. The body 604 has an upstream end 604A that acts as a wedge 650, and a downstream end 604B that acts a slip ring 616. For this embodiment, the wedge part 650 provides the functionalities of the lower wedge 210 and the slip part 616 provides the functionalities of the lower slip part 212. In one embodiment, the slip ring part 616 may be configured to have fingers as illustrated in FIG. 4A to 5. Although the two parts of the body 604 correspond to different elements of a traditional plug, in this embodiment, the two parts are part of a same single body 604. However, the two parts achieve different functionalities. For example, the upstream end 604A is shaped as a wedge while the downstream end 604B has, fingers, each finger having one or more buttons 610 for engaging a casing 660. The buttons 610 are placed in corresponding recesses 612.

Although the wedge part 650 is integrally connected to the slip part 616, when opposite forces are applied to the ends of the plug, the wedge part breaks from the slip ring part and slides inward under the slip ring part and forces the buttons 610 to contact the casing 660. Alternatively, if the transition part 618 between the wedge part 650 and the slip ring part 616 is strong enough, this part would not broke when the opposite forces are applied at the ends of the plug, but rather this part would move radially toward the casing, as the mandrel (not shown) prevents these elements to move toward the longitudinal axis X of the element 601.

Figure 7:
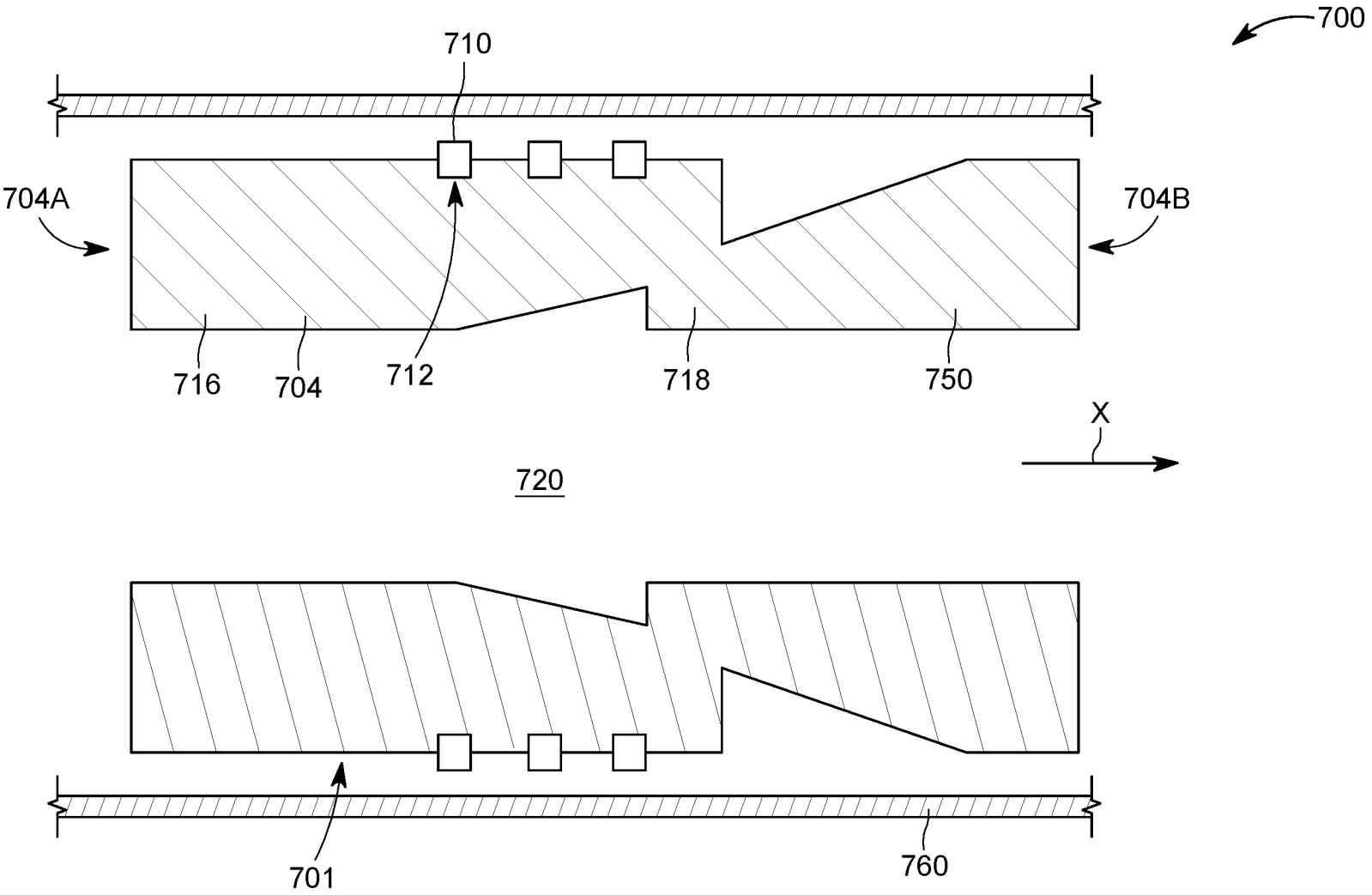
FIG. 7 illustrates still another composite plug that has at least two parts made to have a single, combined body.

FIG. 7 shows another embodiment in which a single, combined element 701 of a plug 700 has a single body 704 corresponding to two parts, a slip ring part 716 and a wedge part 750. These two parts are integrally connected to each other by a transition part 718. For this embodiment, the wedge part 750 provides the functionalities of the upper wedge 206 and the slip part 716 provides the functionalities of the upper slip part 204. The slip part 716 has recesses 712 in which corresponding buttons 710 are placed. The buttons 710 are configured to not slip when engaging the casing 760. The behavior of element 701 is similar to that of element 601, and thus its description is omitted here. A wedge-slip combination as illustrated by elements 601 and 701 would prevent virtually all presets of the corresponding plug.

Figure 8A:
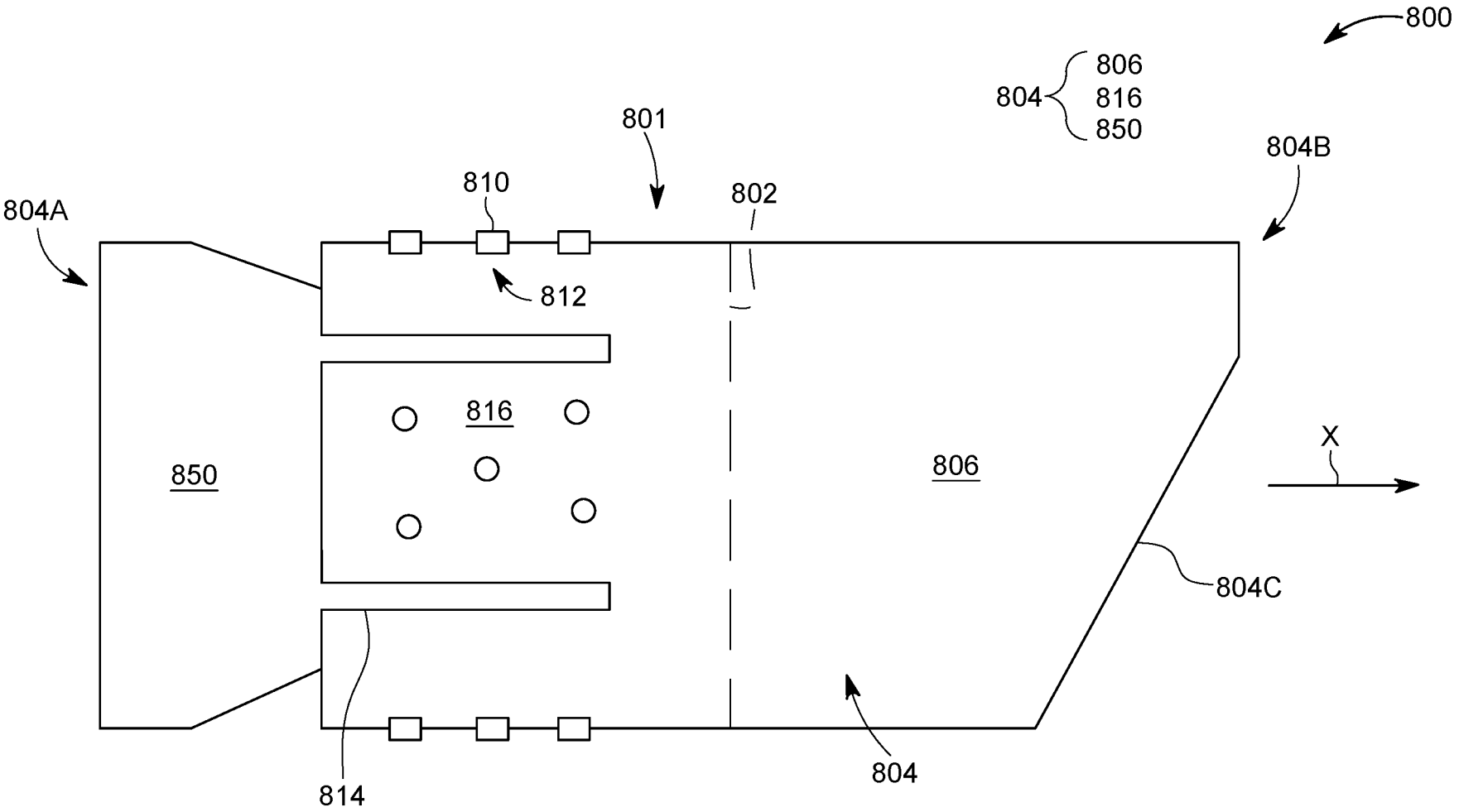
FIGS. 8A to 8C illustrate another composite plug that has at three parts made to have a single, combined body.

In still another embodiment, as illustrated in FIGS. 8A-8D, it is possible to integrate in a single, combined element 801 of a plug 800, the functionalities of three different elements of the plug 200. FIG. 8A shows the single combined element 801 having a body 804 that corresponds to three parts, a mule shoe part 806, a slip ring part 816, and a wedge part 850. Each part is integrally made with the other two parts during a manufacturing process. Each part provides the functionalities of a corresponding part from the plug 200. FIG. 8A also shows the buttons 810 provided in recessed 812 along the slip ring part 816. Optional slots 814 may be formed in the slip ring part 816 along the axis X for the reasons discussed above. The wedge part 850 is placed at the upstream end 804A of the element 801 and the mule shoe part 806 is placed at the downstream end 804A. The mule shoe part 806 has a face 804C that is not perpendicular to the longitudinal axis X.

Figure 8B:
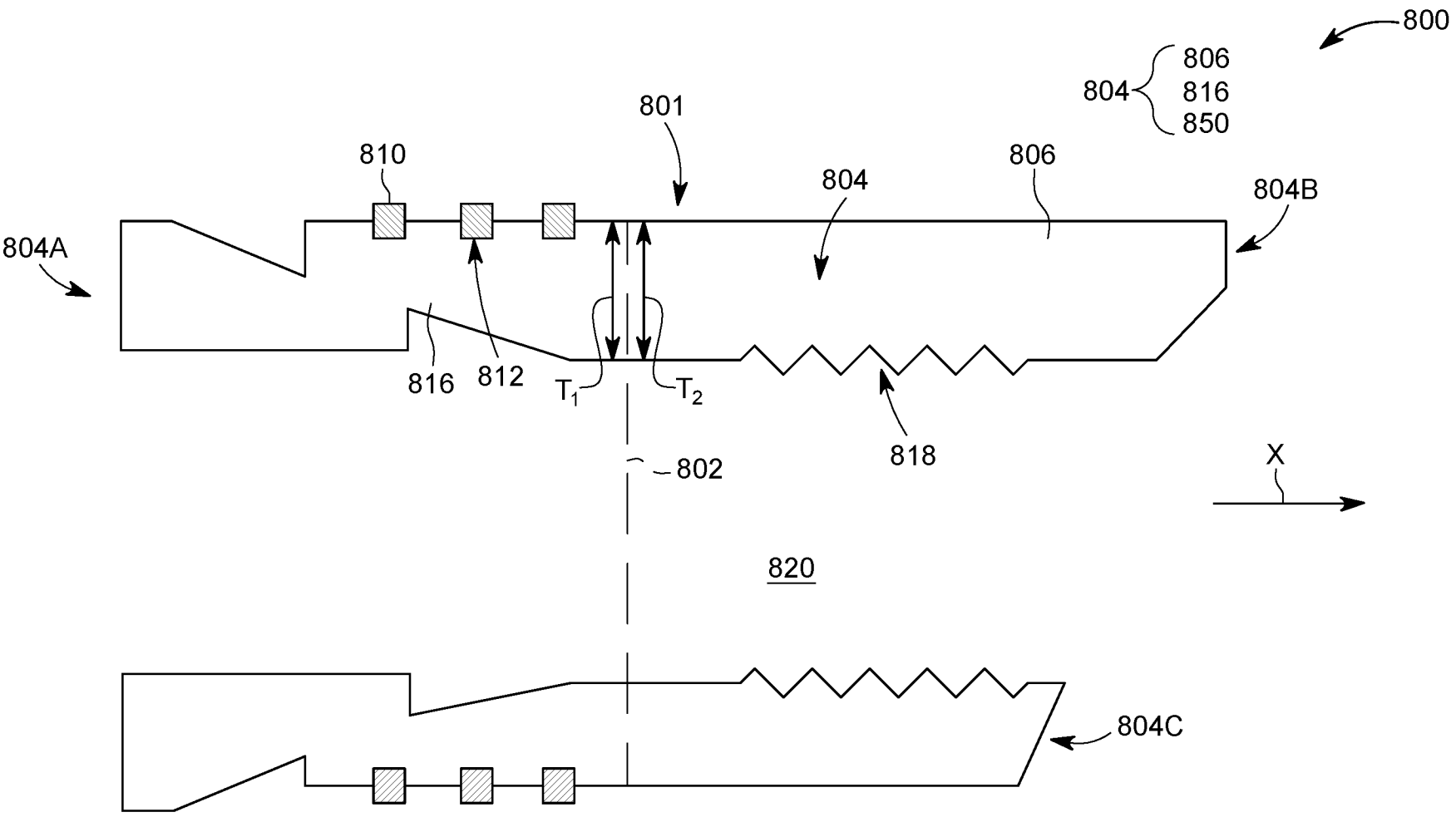
Figure 8C:
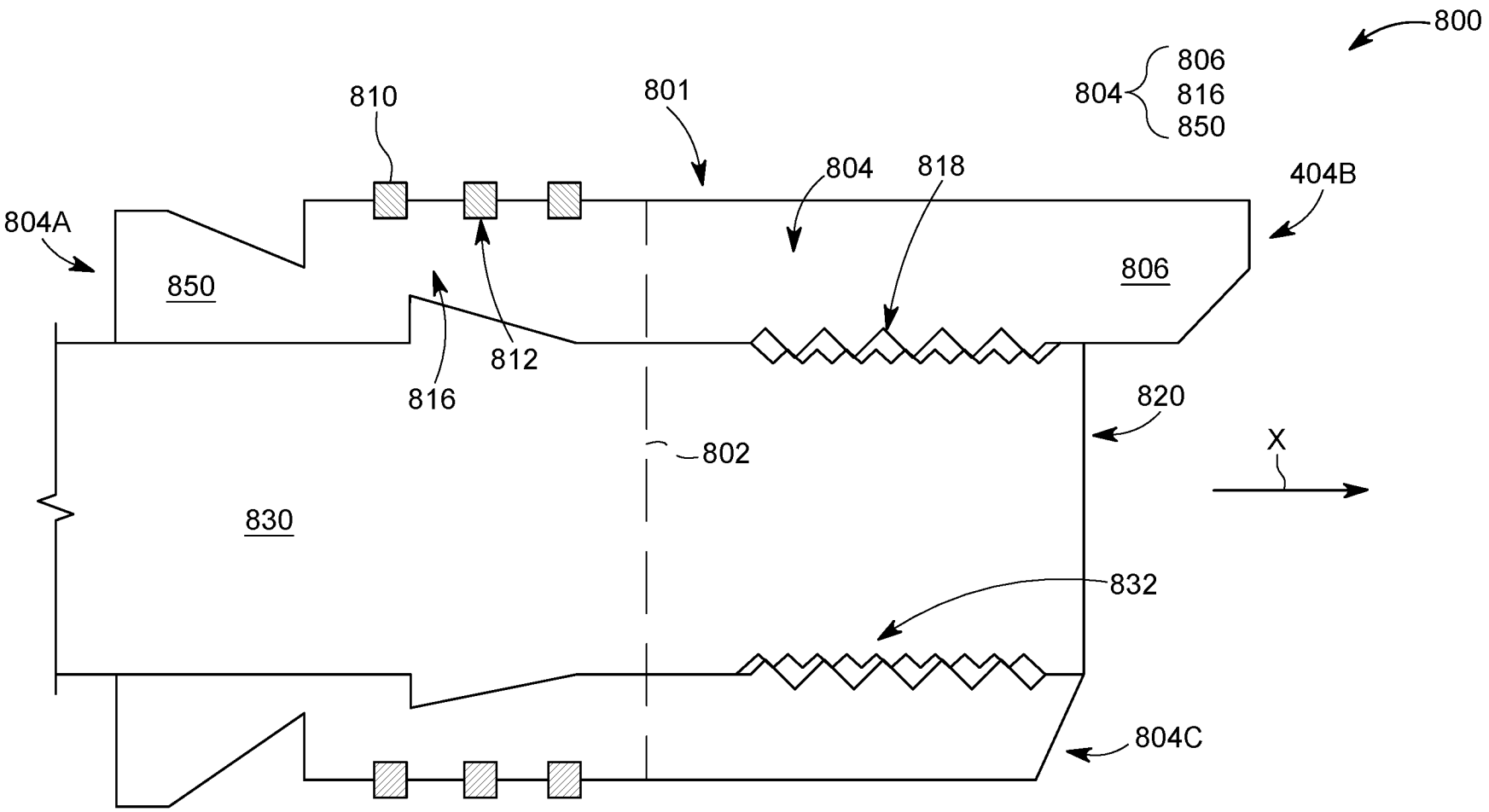

FIG. 8B shows a cross-sectional cut along the longitudinal axis of the element 801. This view shows the single body 804 having a smooth transition between each two adjacent parts, the bore 820 of the element, and the threads 818 formed in the bore for attaching the element to the mandrel. FIG. 8C shows the same element 801 having inside the mandrel 830, and the threads 818 of the mule shoe part 806 being engaged with the corresponding threads 832 of the mandrel. However, as previously discussed, the mule shoe part may be attached by other means to the mandrel.

By integrating three different elements into one, the final plug would be shorter, allow for new design options, eliminate presents, and reduce the loading time on the mandrel of the elements.

Figure 9A:
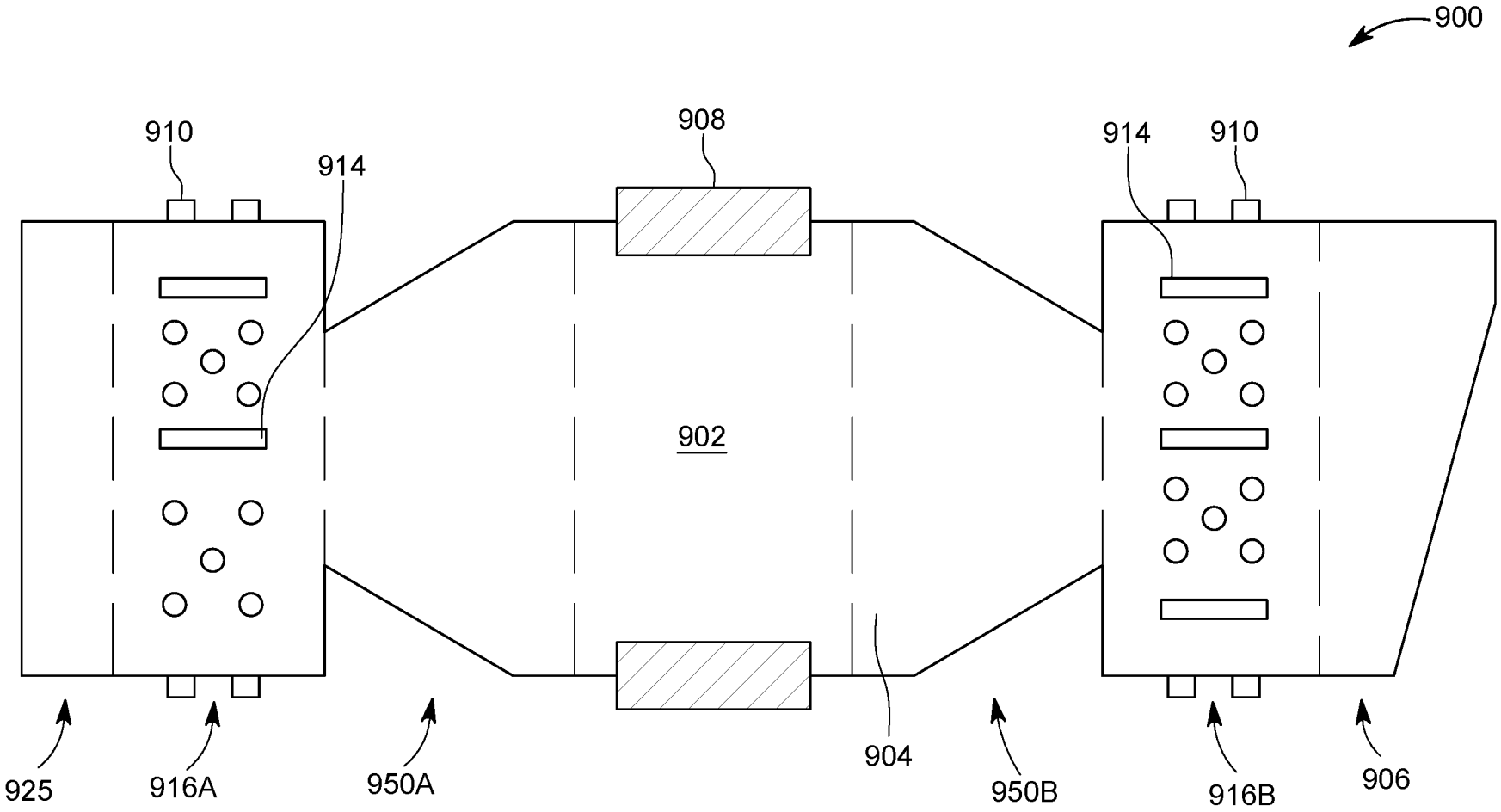
FIGS. 9A and 9B illustrate a composite plug that has all parts, but a sealing element, made to have a single, combined body.
Figure 9B:
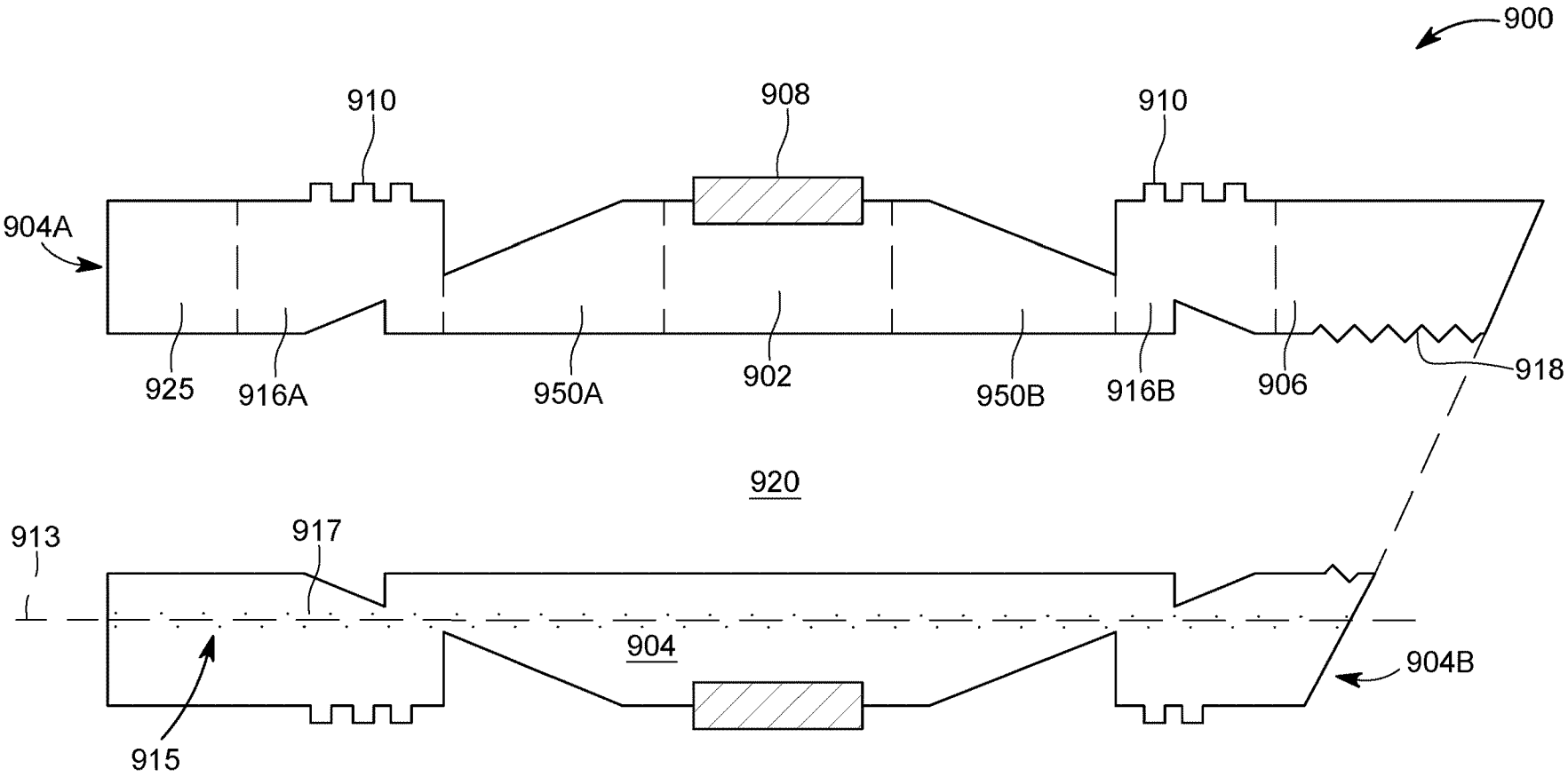

In still another embodiment, as shown in FIGS. 9A and 9B, it is possible to integrate all the elements (less a sealing element of a plug) into a single composite body. FIG. 9A shows such a single piece plug 900 that integrates the functionalities of the top push ring 203 (part 925), the top slip ring 204 (part 916A), the top wedge 206 (part 950A), the bottom wedge 210 (part 950B), the bottom slip ring 212 (part 916B), and the mule shoe 218 (part 906). Different from the plug of FIG. 2, the single, combined plug 900 has a unique body 904 and an elastic sealing member support 902, located between the wedge parts 950A and 950B, that is configured to hold a sealing element 908. Note that the dash lines in the figure suggest the borders between the corresponding elements for the plug 200. However, as previously discussed, during the manufacturing process, there is no interruption or separation between all these parts, and a cross-section of the single, combined plug 900, shown in FIG. 9B, illustrates this continuity feature between the various parts. FIG. 9B also shows the bore 920 of the plug 900, and the threads 918 formed in the bore. Note in this figure the continuous and integral structure of the single body 904 of the plug 900 and the fact that this single body is formed during a single manufacturing process, for example, by winding fibers along a mandrel and impregnating them with a resin.

In this embodiment, it is possible, as illustrated by line 913, that at least one layer 915 of fibers 917 fully extends from the upstream end 904A of the plug 900 to the downstream end 904B of the plug. In one application, the layer 915 of fibers 917 extends through less than all the elements of the plug, e.g., only two or three or four or five or six of the parts.

Figure 10A:
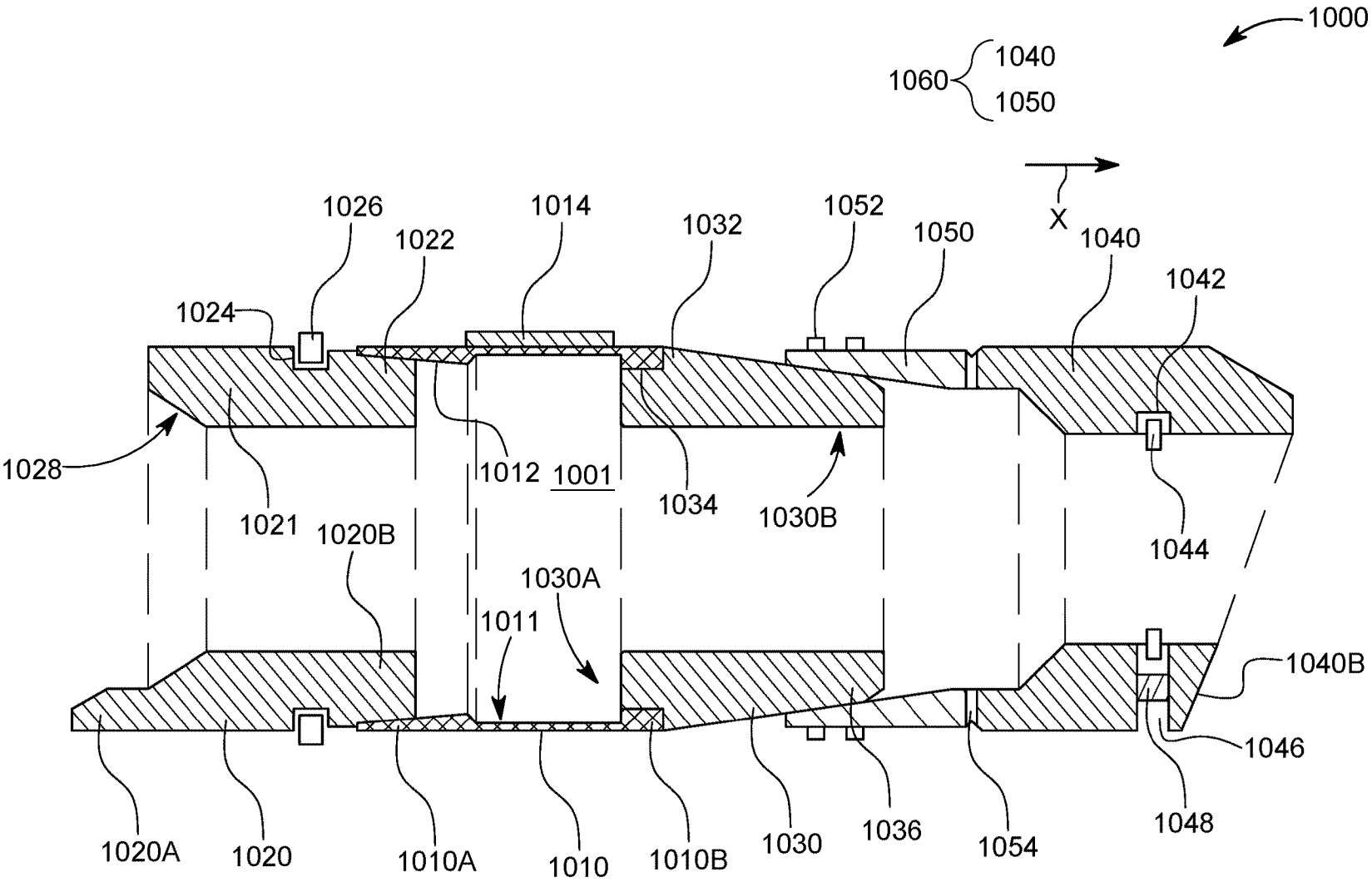
FIGS. 10A to 10C illustrate a mandreless composite plug that has at least two parts made to have a single, combined body.
Figure 10B:
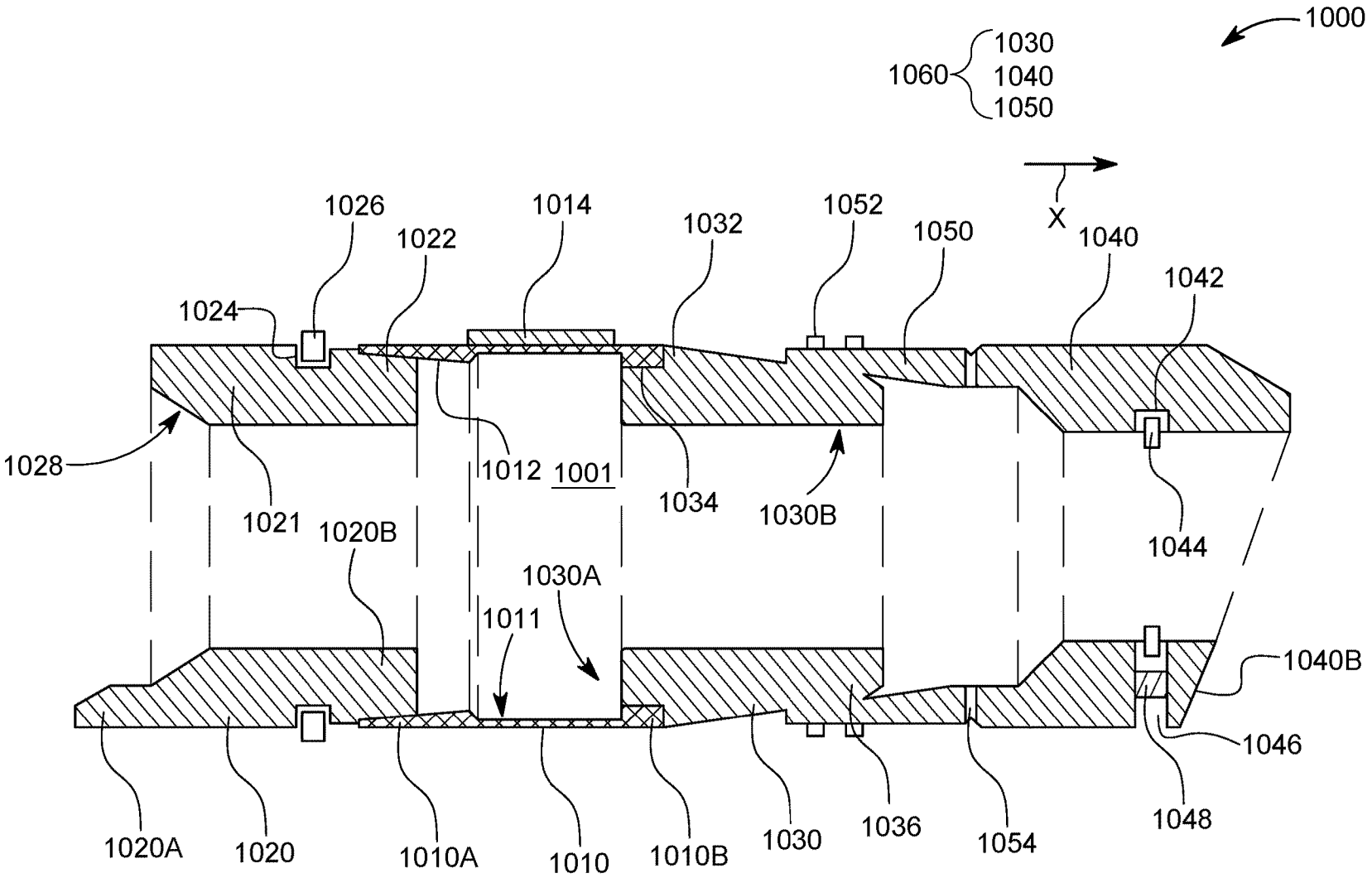

While the above embodiments have been discussed for a plug having a mandrel, the novel concepts presented herein are also applicable to a large-bore plug, i.e., a plug that has no mandrel. FIGS. 10A and 10B show a large-bore plug 1000 that has a plastically deformable sealing element 1010, no internal mandrel, and at least two parts are formed as a single, combined element. Plug 1000 includes a sealing element 1010 sandwiched between a top wedge element 1020 and a central body 1030. Because no mandrel is present, the interior surface 1011 of the sealing element 1010 directly defines the plug's bore 1001. Note that for the traditional plugs that have a mandrel, the mandrel defines the bore and not the added elements. Although the central body 1030 includes the qualifier "central," this term is not used herein to limit this element to a central portion of the plug. Rather this term is used to indicate that element 1030 is central to elements 1010 and 1040. Note that the central body 1030 has a shoulder 1032 and a groove 1034 formed at the upstream end 1030A that are configured to receive the downstream end 10108 of the sealing element 1010. Thus, when compressed between the upper wedge 1020 and the central body 1030, the sealing element 1010 is prevented from moving along the longitudinal axis X, over or under the central body 1030, because of the shoulder 1032. This does not mean that in practice, due to unforeseen circumstances, the sealing element cannot occasionally move past the shoulder 1032.

The sealing element 1010 may include a plastically deformable material. This plastically deformable material is defined as being a ductile material, that suffers an irreversible deformation when the top wedge element and the central body swage it. However, it is possible to also use an elastic material, in addition to the plastically deformable material. In one application, the sealing element 1010 includes a degradable material, which is also plastically deformable, so that the well fluid can degrade the sealing element after a given time. In another application, the sealing element 1010 may be covered with a protective coating 1014. The protective coating 1014 may cover the entire external surface of the sealing element 1010. FIG. 10A schematically illustrates the presence of the protective coating 1014 only on a portion of the sealing element. However, this schematic illustration should be construed to mean that the protective coating can partially or totally cover the sealing element. The coating prevents the plastically deformable material of the sealing element, from being exposed to the well fluid before the plug is set. Especially if the plastically deformable material is also a degradable material, the interaction between the sealing element and the fluids of the well need to be prevented before the sealing element is set. Once the plug is set, the coating 1014 is compromised and the sealing element may start to degrade. The coating 1014 may also be compromised during the milling of the plug rather than or in addition to the setting operation. When the plug is milled, the sealing element may be retained on the inside of the well's casing, which may then fully degrade over time. If non-degradable materials are used for the sealing element, the sealing element may be partially or totally milled such that the remaining restriction is negligible or not significant. In one application, the protective coating 1014 may be elastomeric for additional sealing performance.

The upstream end 1010A of the sealing element 1010 extends over the wedge portion 1022 of the top wedge element 1020, as shown in FIG. 10A. The wedge portion 1022 of the top wedge element 1020 receives the upstream end 1010A and is designed (by making a non-zero angle relative to the longitudinal axis X) to promote an advance of the upstream end 1010A of the sealing element 1010 along the negative direction of the longitudinal axis X, over the external diameter of the top wedge element 1020. In other words, the internal diameter of the upstream end 1010A of the sealing element is slightly larger than the external diameter of the downstream end 1020B of the top wedge element 1020 so that, in its original, initial, state, the sealing element extends partially over the edge portion 1022, as shown in FIG. 10A. Due to the friction between the sealing element and the top wedge element, these two elements will stay connected to each other without the need of using one or more fasteners.

Further, the top wedge element 1020 includes one or more pockets 1024, formed in the body 1021 of the top wedge element 1020. In one embodiment, the pockets may communicate with each other so that a groove is formed around an external circumference of the top wedge element 1020. These pockets 1024 are used for accommodating corresponding locking buttons 1026. If the pockets communicate with each other, the locking buttons may be replaced by a locking ring. The purpose of the locking buttons or locking ring is to engage with the interior part 1012 of the sealing element 1010, and to fix a position of the top wedge element relative to the sealing element. The locking buttons may be made from a tough material, for example, a metal. In this way, the top wedge element 1020 achieves the functionalities of the top slip ring and the top wedge of a traditional plug.

The top wedge element 1020 may also include a seat 1028 located at the upstream end 1020A. The seat 1028 is manufactured into the body 1021 for accommodating a ball (not shown), which may be used to close the plug. As shown in the figure, the seat 1028 has surfaces slanted relative to the longitudinal axis X. While this is a desired feature for a plug, one skilled in the art would understand that this is not a necessary feature.

The central body 1030 has a wedge portion 1036 at the downstream end 1030B, which is configured to engage with the slip ring part 1050. The slip ring element 1050 includes one or more protuberances 1052, formed on the exterior surface of the slip element, as shown in FIG. 10A. The protuberances 1052 are formed from a material that is hard enough so that when the protuberances are pressed against the well's casing, they "bite" into the metal of the well's casing and fixedly engage with the wall of the casing. These protuberances will ensure that the plug does not move along the longitudinal axis X after the plug is set and large pressures are applied to the well. Although FIG. 10A shows the central body 1030 being made as a different part than the slip ring element 1050, as discussed in the previous embodiments, it is possible to make the two elements as a single, combined element. FIG. 10B shows an implementation of the plug 1000 in which the central body part, the slip ring part, and the mule shoe are formed as a single, combined element 1060. In still another embodiment, as illustrated in FIG. 100, it is possible to integrate all the elements of the large-bore plug 1000, except the sealing element 1010, into a single, combined element 1060. For this embodiment, it is possible to either reinforce the bore part of a transitional part 1070, between the top wedge element 1020 and the central body 1030, so that when under tension, that portion supports the sealing element, or a layer of a different material is inserted into the transitional part, and this layer promotes a movement of the top wedge part under the sealing element.

In the embodiment shown in FIG. 10A, the slip ring part 1050 is formed integrally with the mule shoe part 1040. A groove 1054 is formed between the slip ring part 1050 and the mule shoe part 1040 so that the slip ring part can "petal" relative to the mule shoe part, when the shoe mule is pushed toward the central body. In other words, the slip ring part 1050 may be formed to have plural fingers as shown in FIGS. 4A to 4D, each finger being attached to the mule shoe part 1040 at the groove 1054, but adjacent parts are not connected to each other. This ensures that when the slip ring part 1050 moves up the wedge portion 1036 of the central body 1030, the various fingers can bend at the groove, and move outwardly (radially) toward the casing of the well, so that the protuberances 1052 of each finger engage the casing. Thus, in this embodiment, the slip ring part 1050 is integrated with the mule shoe part 1040 into a single element 1060 having a single unitary body, i.e., the two parts are made of the same material during a same manufacturing step. In one application, both the slip ring part 1050 and the mule shoe part 1040 are made of a composite material.

Figure 10C:
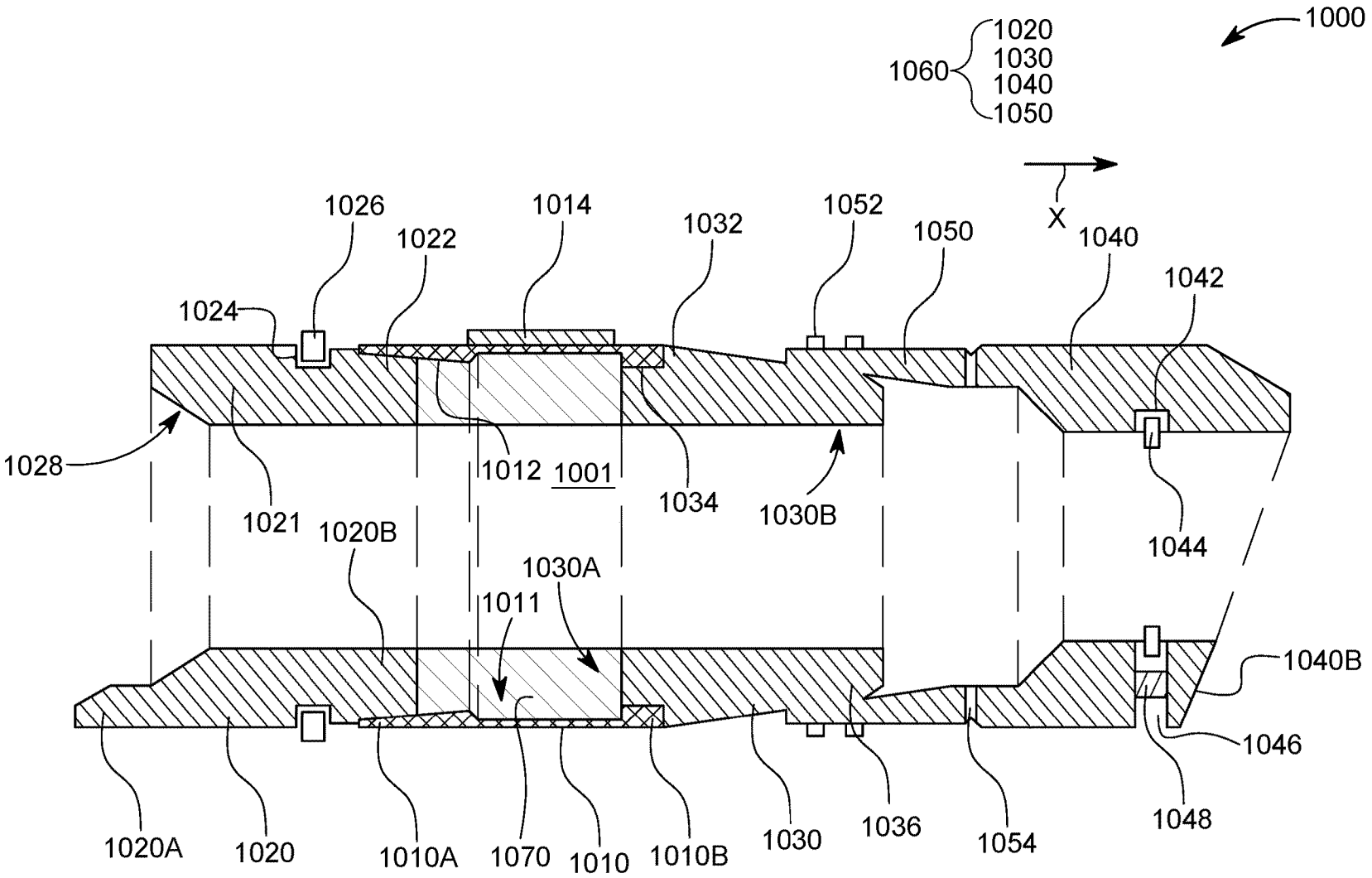

In these embodiments, the mule shoe part 1040 has an additional function, which is unique to this plug with no mandrel. The mule shoe part 1040 hosts a shear element 1044 (see FIGS. 10A to 10C) that is configured to engage a mandrel of a setting tool (not shown) when the setting tool needs to set the plug. The shear element 1044 is implemented in this embodiment as a shear ring 1044 that is located in a trench/groove 1042 formed in the body of the mule shoe part. The mule shoe part 1040 has a lateral opening 1046 through which the ring 1044 may be inserted or retrieved into the shoe. The opening 1046 may be blocked with a material 1048 after the shear ring 1044 is inserted to prevent it from exiting the mule shoe part. The shear ring may be made of metal, composite, or any other material that would withstand the force applied by the setting tool for setting the plug. In one application, the shear element 1044 is formed as a thread directly into the body of the mule shoe part.

The sealing element may be made from one or more ductile materials, which are malleable. An example of such a material could be a metal, a plastic, a thermoplastic material, etc. In this regard, hard thermosetting plastics, rubber, crystals and ceramics are considered to not be a plastically deformable material. In one application, the plastically deformable sealing element may include an elastic component, for example, an elastic section and a brittle section. In this application, the elastic section is located toward the casing and the brittle section is located toward the bore of the plug.

Figure 11:
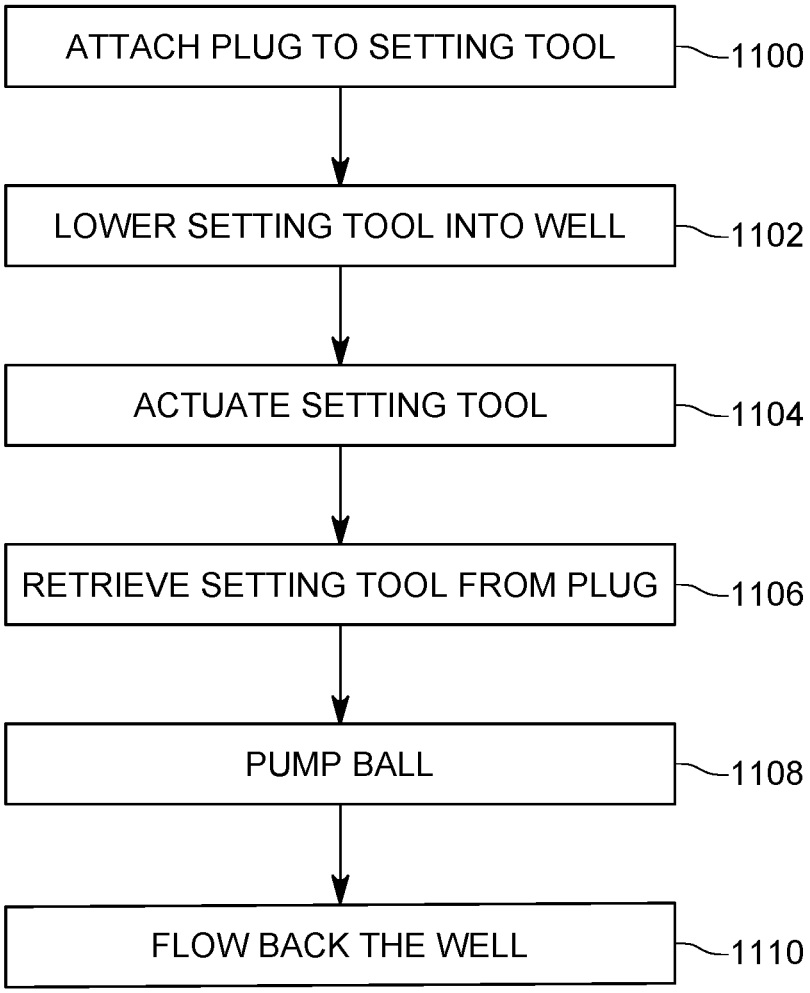
FIG. 11 is a flowchart of a method for setting one of the plugs noted above.
Figure 12:
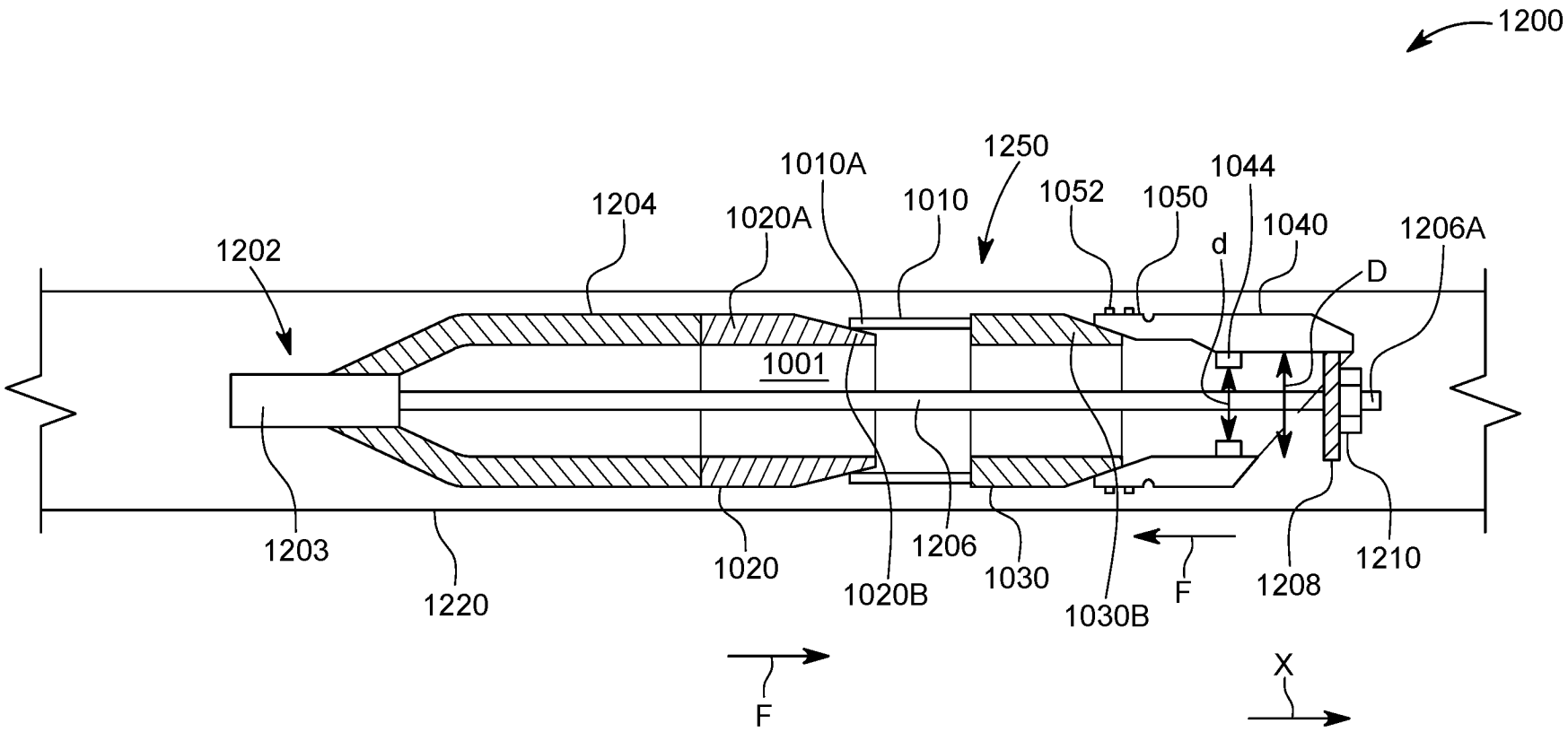
FIG. 12 illustrates a setting tool that sets a plug as discussed above.

A method for setting one of the plugs discussed above is now discussed with regard to FIG. 11. In step 1100, a setting tool 1202, which is illustrated in FIG. 12, is attached to the plug 1250. As an example, plug 1250 is similar to plug 1000 previously discussed. However, plug 1250 may be any of plugs 400, 500, 600, 700, 800, 900, and 1000 previously discussed. FIG. 12 shows the system 1200 including the setting tool 1002 and the plug 1250 already attached to each other. The setting tool 1202 includes a setting sleeve 1204 that contacts the upstream end 1020A of the top wedge element 1020. A mandrel 1206 of the setting tool 1202 extends all the way through the bore 1001 of the plug 1000, until a distal end 1206A of the mandrel exits the mule shoe part 1040. A disk or nut 1208 is attached to the distal end 1206A of the mandrel. If a disk is used, then a nut 1210 may be attached to the mandrel 1206 to maintain in place the disk 1208. An external diameter D of the disk 1208 is designed to fit inside the bore of the mule shoe part 1040, but also to be larger than an internal diameter d of the shear ring 1044 or another element (e.g., a collet) that may be used for engaging the mandrel.

In step 1102, the system 1200 is lowered into the well's casing 1220, at a desired position. Then, in step 1104, the setting tool 1202 is actuated by known means, which are not discussed herein. As a result of this step, the mandrel 1206 is pulled toward the main body 1203 of the setting tool 1202, thus applying a force F on the mule shoe part 1040. The setting tool sleeve 1204 prevents the plug 1000 from moving along the longitudinal axis X of the casing 1220, thus applying a reactionary force F on the top wedge part 1020. Because there is a force F applied to the mule shoe part 1040 by the disk 1208 and an opposite force F applied by the sleeve 1204 to the top wedge part 1020, these two elements start to move toward each other.

During this process, the downstream end 1020B of the top wedge part 1020 slides under the upstream end 1010A of the sealing element 1010 and the slip ring part 1050 slides over the downstream end 1030B of the central body 1030. As a result of this, the protuberances 1052 of the slip ring part 1050 are now in direct contact with the casing 1220 as they are pushed toward the casing by the wedge part of the central body 1030. The sealing element 1010 is pushed toward the casing 1220 so that no fluid passes between the plug and the casing, i.e., the plug is set.

Next, the operator pumps down the well, in step 1108, a ball (not shown) that would seat on the seat 1028 formed in the top wedge element 1020. The ball may be made of a degradable material, or to have various passages through the entire body or only partially through the body, so that it can degrade quicker when interacting with the well fluids. At this time, the plug 1250 has fully sealed the well for any fluid that is pumped from upstream of the plug.

The operator may later, in step 1110, decide to flow back the well. This means that the pressure upstream the set plug is reduced below the pressure downstream the plug so that fluids from the formation around the well enter the casing and flow up the casing. If this happens, the ball moves upstream from the plug 1250. However, if another plug has been deployed below the current plug 1250, another ball associated with that plug is moving toward the mule shoe part 1040 and blocks it. Thus, for this situation, if the other ball has not degraded enough to pass through the bore 1001 (which is a large bore) of the plug 1250, one or more passages (not shown) formed in the mule shoe part 1040 allow the well fluids to bypass the and move upstream.

Figure 13:
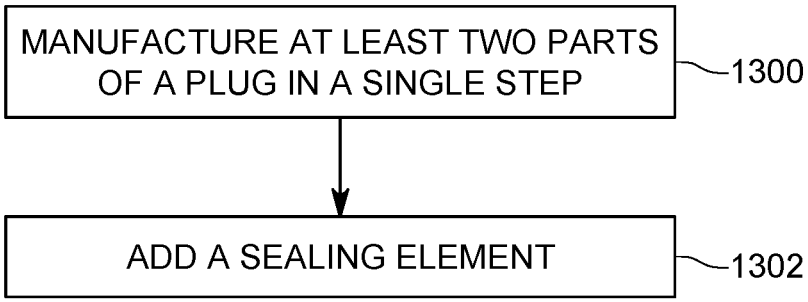
FIG. 13 is a flowchart of a method for manufacturing one plug as discussed above.

A method for manufacturing a downhole isolation plug 900 for sealing a casing in a well is now discussed with regard to FIG. 13. The method includes a step 1300 of manufacturing at least two parts 906, 916 of plural parts 906, 916, 950, 925 during a single step by using a composite material, each part having a preset functionality with regard to sealing the casing, and a step 1302 of adding 1302 a sealing element 908 to the plural parts, wherein the sealing element is configured to seal the casing. The at least two parts of the plural parts have a single, combined body 904. In one application, the body includes at least one layer of fibers, and the layer extends from an upstream end of the body to a downstream end of the body. The fibers of the layer are added at the same time across the entire body. In one embodiment, the two parts correspond to a slip ring and a mule shoe of a plug that has the slip ring separated from the mule shoe. In another embodiment, the at least two parts correspond to a slip ring and a push ring of a plug that has the slip ring separated from the push ring. In still another embodiment the at least two parts correspond to a mule shoe, a slip ring and wedge of a plug that has each of the mule shoe, slip ring, and the wedge separated from each other. In yet another embodiment, the at least two parts include all the plural parts.

The mule shoe element of the plugs 400 or 800 or 900 is shown being attached with a corresponding thread 418, 818, or 918 to the mandrel of the plug. Another method known in the art for attaching the mule shoe to the mandrel is the use of pins, which are inserted through the body of the mule shoe into the mandrel. The mule shoe is used as a reaction component during the setting of the plug. This means that the mandrel, which is connected to the mule shoe, is pulled and the push ring riding on the surface of the plug is pushed down, compressing the plug. The connection between the mule shoe and the mandrel must withstand the total setting force. If this connection fails, the plug also fails to set properly and will not hold pressure, or may even be pumped down the well during the fracture operation. This results in fracturing the same stage twice, as all of the fluid will be injected into the previous fracture, which is more conductive than the unfractured stage in most cases, and which is undesirable.

Most plugs contain a feature at the top end, which is intended to shear before the mule shoe fails. This feature can be a shear ring, or a set of shear pins. The shear feature is designed to shear and release the setting tool at the optimum setting force. The strength of the mule shoe connection must be greater than the shear force of the shear feature. As noted above, the mule shoe may be connected to the mandrel with composite pins. Pins are a reliable way to connect the mule shoe, but are labor intensive because the mule shoe and the mandrel must be match drilled in a jig. A threaded connection, as shown in FIGS. 4, 8, and 9 promotes easy assembly, but can cause failure with a certain material and thread design combinations, which imposes limitations on the composite plug design.

Figure 14:
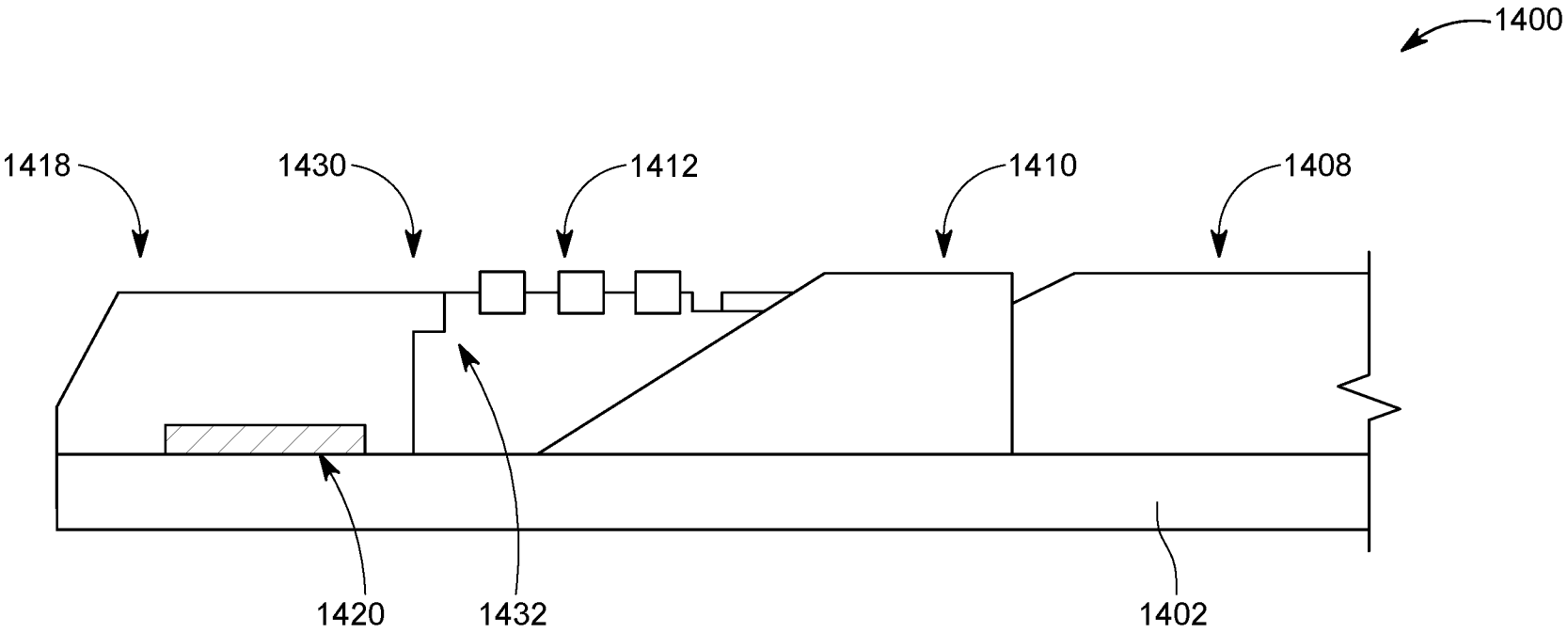
FIG. 14 illustrates a plug that has the mule shoe attached to a mandrel with a new locking element.

Thus, according to an embodiment illustrated in FIG. 14, instead of using pins or threads for attaching the mule shoe part to the mandrel, a locking element 1420 is provided at an interface between the mandrel 1402 and the mule shoe 1418. Note that this locking mechanism works whether the mule shoe is a single part as in FIG. 2 or is made integrally with other parts of the plug as in FIG. 3. For simplicity, in the following embodiments, the mule shoe 1418 is considered to be an independent part of the plug. FIG. 14 also shows the lower slip ring 1412, the lower wedge 1410, and the sealing element 1408. The elements of the plug not shown in FIG. 14 are similar to those shown in FIG. 2. FIG. 14 also shows a retaining element 1430 that may be provided between the mule shoe 1418 and the lower slip ring 1412 for retaining the lower slip ring. The retaining element 1430 may be part of the mule shoe 1418. In one application, the lower slip ring 1412 has a shoulder 1432 for accommodating the retaining element 1430. However, this retaining element and associated shoulder 1432 are optional.

Figure 15A:
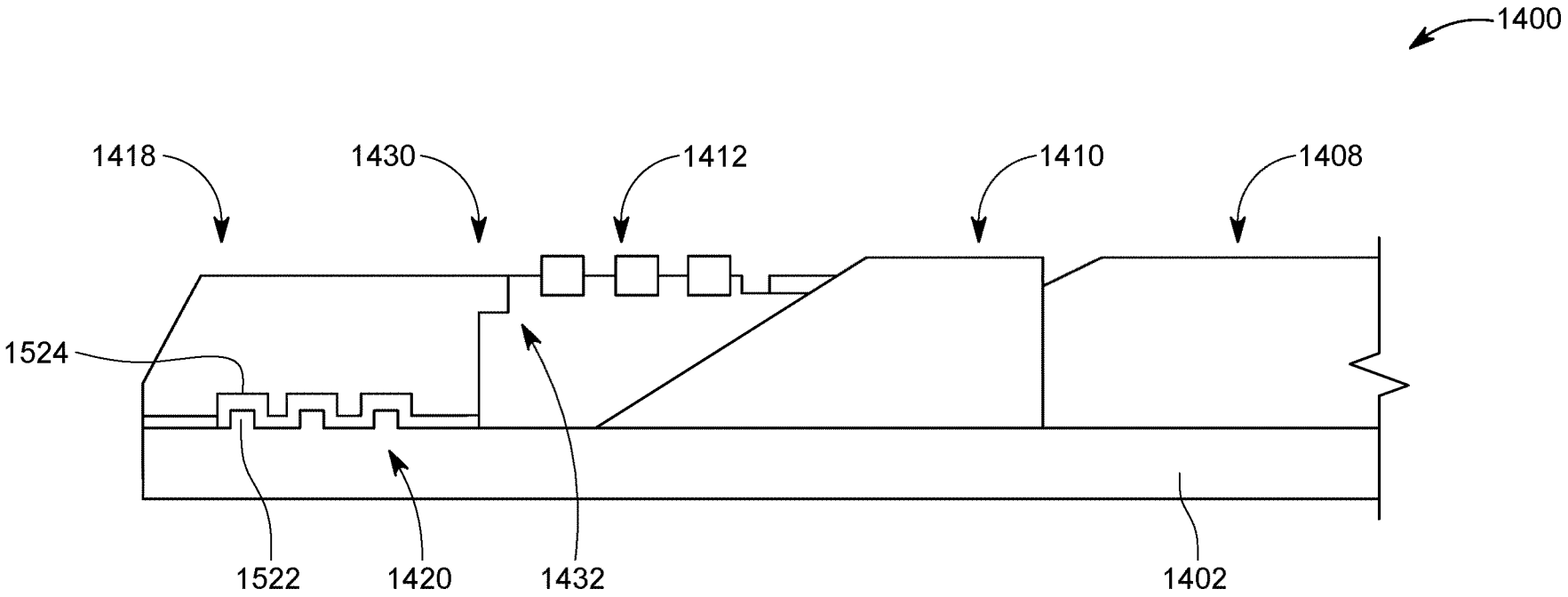
FIGS. 15A to 15C show various implementations of the new locking element.

The locking element 1420 may be implemented in one application as ceramic buttons 1522, as shown in FIG. 15A, which are formed on the exterior surface of the mandrel 1402 in a given pattern, for example, helical. A matching pattern of J slots 1524 (to achieve a pin and groove assembly) may be formed into the mule shoe 1418. Thus, the mule shoe may be slotted onto the mandrel and then locked with a quarter turn. In one variation, a zig zag pattern may be used.

Figure 15B:
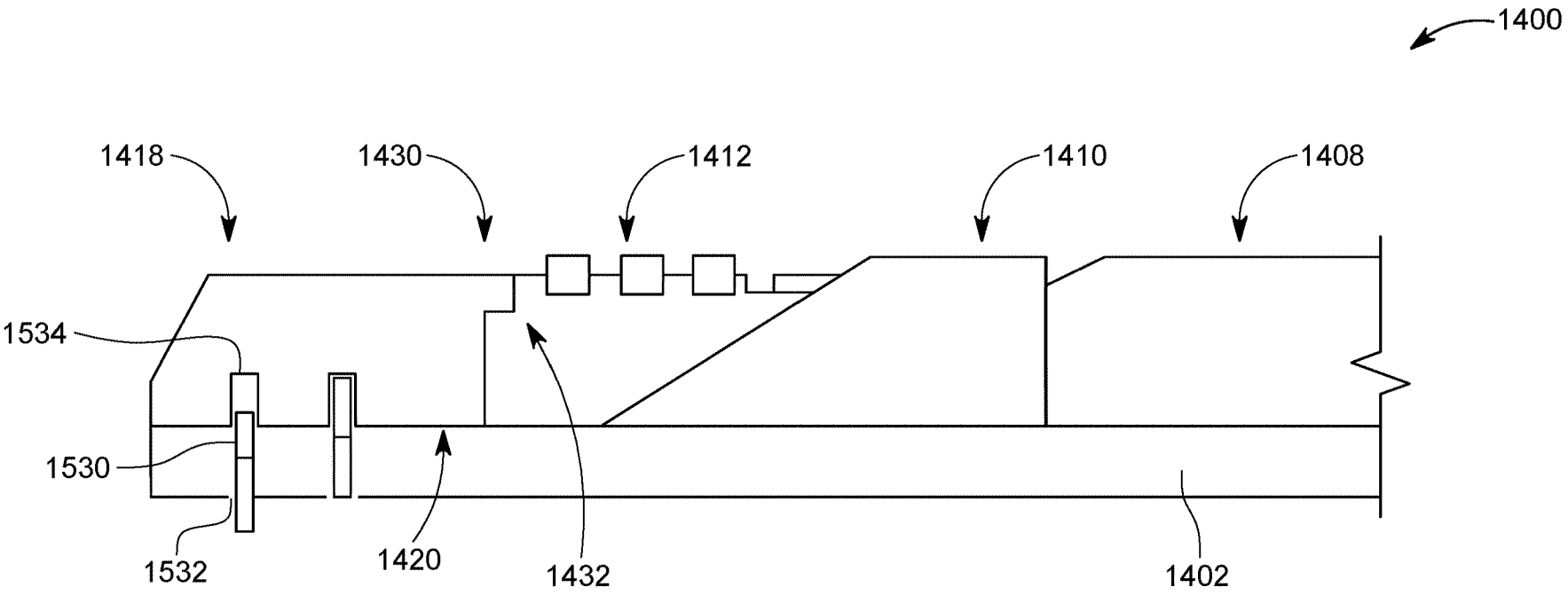
Figure 15C:
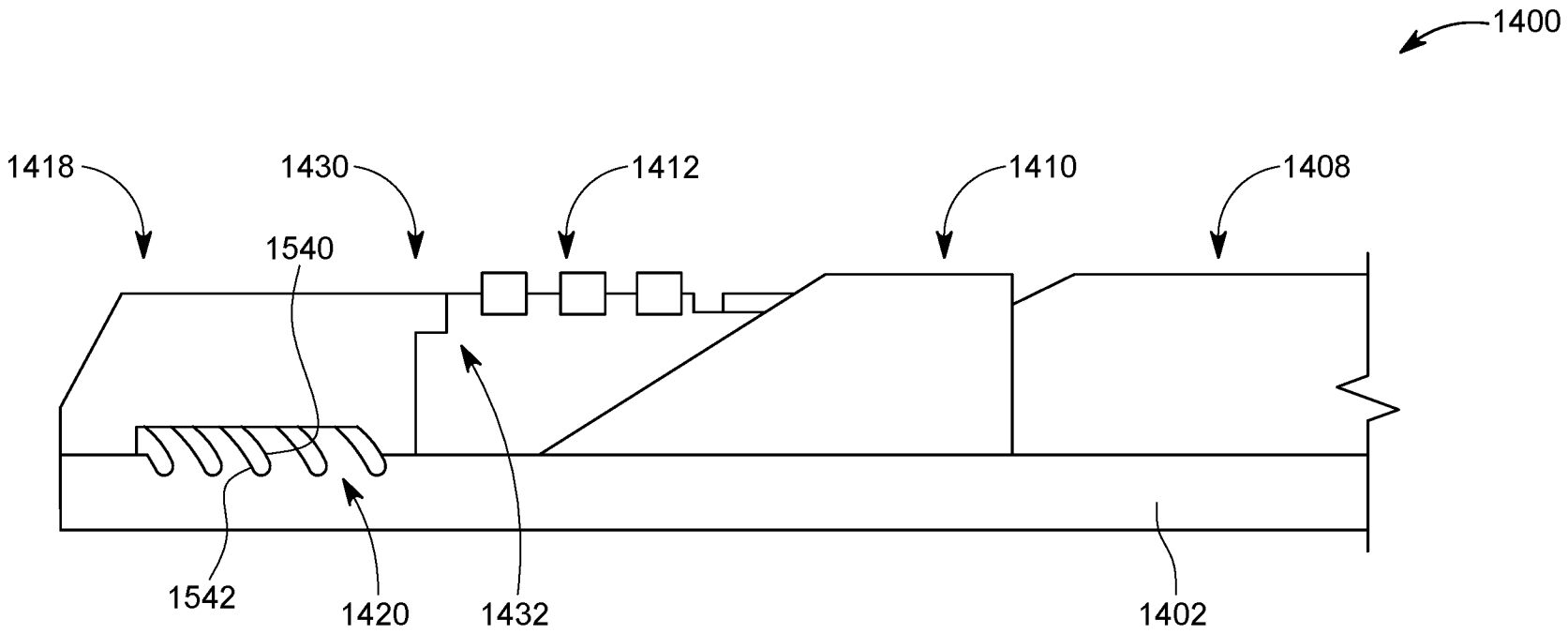

In another embodiment, as illustrated in FIG. 15B, composite dowel pins 1530 can be inserted through holes 1532 made in the interior of the mandrel 1420 and recesses 1534 formed into the mule shoe 1418, as illustrated in FIG. 15B. In still another embodiment, the locking element 1420 may be a multi-start thread consisting of two or more intertwined threads 1540 and 1542 running parallel to one another. Intertwining threads 1540 and 1542 allow the lead distance of a thread to be increased without changing its pitch. A double start thread will have a lead distance double than that of a single start thread of the same pitch, a triple start thread will have a lead distance three times longer than a single start thread of the same pitch, and so on. In one variation, the locking element 1420 is an interrupted thread, i.e., a thread that only partially extends along a circumference of the mandrel, while at least one part being flat, with no threads. In this case, a single pin could be used to lock the rotation of the mule shoe to the mandrel.

Figure 16:
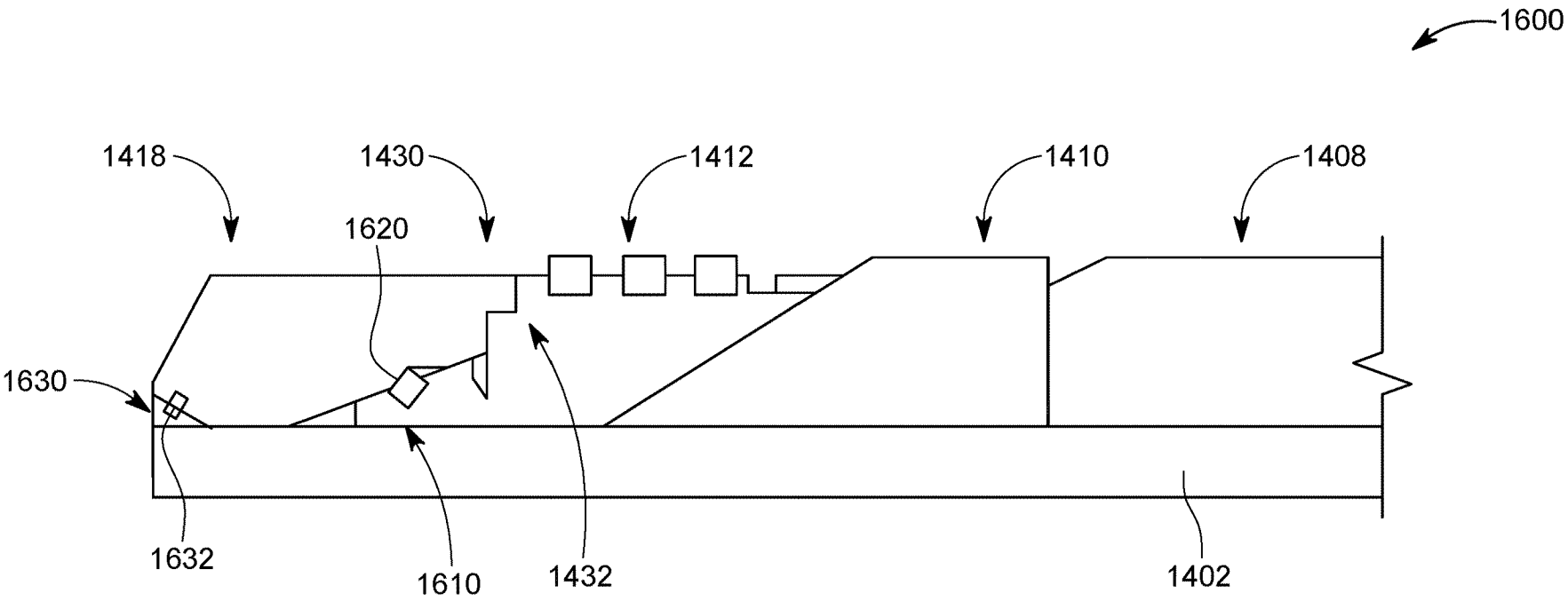
FIG. 16 shows the mule shoe being attached to the mandrel with two wedges.

In still another embodiment, as illustrated in FIG. 16, the mule show 1600 may be locked in place with a reverse wedge 1610. The reverse wedge 1610 would tighten as the plug is set. The reverse wedge 1610, as shown in FIG. 16, is placed to push the mule show toward the casing, i.e., away from the mandrel. The wedge angle could be selected to match an angle to the mule shoe. Ceramic buttons 1620 could be used to lock the parts together. The reverse wedge 1610 could be segmented for easy compression. In one application, the reverse wedge 1610 could be made as one element with the slip ring 1412, i.e., to have at least one common layer of material. In one variation, a second wedge 1630 may be added between the mule shoe 1418 and the mandrel 1402, at the free end of the mule shoe, as also shown in FIG. 16. Optionally, buttons 1632 may be placed between the second wedge 1630 and the mule shoe 1418.

The disclosed embodiments provide methods and systems for obtaining a plug with increased versatility and reduced cost. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A downhole isolation plug for sealing a casing in a well, the downhole isolation plug comprising:

plural parts made of a composite material, each part having a preset functionality with regard to sealing the casing; and a sealing element configured to seal the casing, wherein at least two parts of the plural parts have a single, combined body, wherein the body includes at least one layer of fibers, and the layer extends from an upstream end of the body to a downstream end of the body, and wherein the body has a same thickness at a region where the at least two parts are combined.

2. The plug of claim 1, wherein the two parts correspond to a slip ring and a mule shoe.

3. The plug of claim 2, wherein the part that corresponds to the slip ring has plural buttons for engaging the casing.

4. The plug of claim 3, wherein the part that corresponds to the mule shoe has an oblique face relative to a longitudinal axis of the plug.

5. The plug of claim 3, wherein the part that corresponds to the mule shoe part has threads inside of a bore for being attached to a mandrel.

6. The plug of claim 1, wherein one part of the plural parts is a mandrel and the other plural parts are located on the mandrel.

7. The plug of claim 1, wherein there is no mandrel.

8. The plug of claim 1, wherein the at least two parts correspond to a slip ring and a push ring.

9. The plug of claim 1, wherein the at least two parts correspond to a mule shoe, a slip ring and a wedge.

10. The plug of claim 1, wherein the at least two parts include all the plural parts.

11. The plug of claim 1, wherein the sealing element is plastically deformable.

12. A method of manufacturing a downhole isolation plug for sealing a casing in a well, the method comprising:

manufacturing at least two parts of plural parts during a single step by using a composite material, each part having a preset functionality with regard to sealing the casing; and adding a sealing element to the plural parts, wherein the sealing element is configured to seal the casing, wherein the at least two parts of the plural parts have a single, combined body, wherein the body includes at least one layer of fibers, and the layer extends from an upstream end of the body to a downstream end of the body, and wherein the body has a same thickness at a region where the at least two parts are combined.

13. The method of claim 12, wherein the fibers of the layer are added at the same time across the entire body.

14. The method of claim 12, wherein the two parts correspond to a slip ring and a mule shoe.

15. The method of claim 12, wherein the at least two parts correspond to a slip ring and a push ring.

16. The method of claim 12, wherein the at least two parts correspond to a mule shoe, a slip ring and a wedge.

17. The method of claim 12, wherein the at least two parts include all the plural parts.

18. A downhole isolation plug for sealing a casing in a well, the downhole isolation plug comprising:

a slip ring disposed on a mandrel;

a mule shoe also disposed on the mandrel;

a sealing element configured to seal the casing; and a wedge that is partially placed under the mule shoe and is configured to press the mule shoe away from the mandrel, wherein the mule shoe is attached to the mandrel with a locking mechanism located at an interface between the mandrel and the mule shoe, wherein the slip ring and the mule shoe are made unitary, as a single element, from a composite material, and wherein the single element includes at least one layer of fibers, and the layer extends from a downstream end to an upstream end of the single element.

19. The plug of claim 18, wherein the locking element includes ceramic buttons, formed on the mandrel, which are configured to engage with J slots formed in the mule shoe.

20. The plug of claim 18, wherein the locking element includes dowel pins configured to extend from an interior bore of the mandrel into the mule shoe.

21. The plug of claim 18, wherein the locking element includes multi-lead threads or interrupted threads.

* * * * *